US010852060B2

(12) United States Patent
Prim

(10) Patent No.: US 10,852,060 B2
(45) Date of Patent: Dec. 1, 2020

(54) SINGLE-UNIT GAS SEPARATION PROCESS HAVING EXPANDED, POST-SEPARATION VENT STREAM

(75) Inventor: Eric Prim, Houston, TX (US)

(73) Assignee: Pilot Energy Solutions, LLC, Houston, TX (US)

( * ) Notice: Subject to any disclaimer, the term of this patent is extended or adjusted under 35 U.S.C. 154(b) by 320 days.

(21) Appl. No.: 13/295,601

(22) Filed: Nov. 14, 2011

(65) Prior Publication Data

US 2012/0255325 A1 Oct. 11, 2012

Related U.S. Application Data

(60) Provisional application No. 61/473,315, filed on Apr. 8, 2011.

(51) Int. Cl.
*F25J 3/08* (2006.01)
*F25J 3/02* (2006.01)

(52) U.S. Cl.
CPC ..... *F25J 3/0209* (2013.01); *F25J 3/0233* (2013.01); *F25J 3/0242* (2013.01);
(Continued)

(58) Field of Classification Search
CPC ..... F25J 3/0209; F25J 3/0233; F25J 3/0242; F25J 3/0238
(Continued)

(56) References Cited

U.S. PATENT DOCUMENTS 3,367,122 A 2/1968 Tutton
4,022,597 A 5/1977 Bacon
(Continued)

FOREIGN PATENT DOCUMENTS

CA 2448884 A1 12/2002
CA 2605862 A1 4/2008
(Continued)

OTHER PUBLICATIONS

Foreign Communication From a Counterpart Application, Canadian Application No. 2770658, Canadian Office Action dated Jun. 13, 2013, 4 pages.
(Continued)

*Primary Examiner* — Brian M King
(74) *Attorney, Agent, or Firm* — Conley Rose, P.C.; Grant Rodolph; Nicholas K. Beaulieu

(57) ABSTRACT

A process comprising separating a hydrocarbon feed stream into a natural gas-rich stream and a liquefied petroleum gas (LPG)-rich stream using process equipment comprising only one multi-stage separation column, wherein the natural gas-rich stream has an energy content of less than or equal to about 1,300 British thermal units per cubic foot (Btu/ft$^3$), and wherein the LPG-rich stream has a vapor pressure less than or equal to about 350 pounds per square inch gauge (psig). A process comprising separating a hydrocarbon feed stream into a top effluent stream and a LPG-rich stream, and subsequently expanding the top effluent stream to produce a natural gas-rich stream. An apparatus comprising a multi-stage separation column configured to separate a hydrocarbon feed stream into a top effluent stream and a LPG-rich stream, and an expander configured to expand the top effluent stream and produce a natural gas-rich stream.

22 Claims, 5 Drawing Sheets

(52) U.S. Cl.
CPC ..... *F25J 2200/02* (2013.01); *F25J 2200/74* (2013.01); *F25J 2270/04* (2013.01); *F25J 2270/90* (2013.01)

(58) Field of Classification Search
USPC ..... 62/617, 618, 619, 621
See application file for complete search history.

(56) References Cited

U.S. PATENT DOCUMENTS

| | | | | | |
|---|---|---|---|---|---|
| 4,128,410 | A * | 12/1978 | Bacon | B01D 3/322 | 62/623 |
| 4,171,964 | A * | 10/1979 | Campbell | F25J 3/0209 | 62/621 |
| 4,251,249 | A | 2/1981 | Gulsby | | |
| 4,846,863 | A | 7/1989 | Tomilson et al. | | |
| 4,854,955 | A * | 8/1989 | Campbell | F25J 3/0209 | 62/621 |
| 4,951,503 | A * | 8/1990 | Fini | 73/23.35 | |
| 5,030,339 | A | 7/1991 | Czarnecki | | |
| 5,275,005 | A | 1/1994 | Campbell et al. | | |
| 5,291,736 | A | 3/1994 | Paradowski | | |
| 5,309,720 | A * | 5/1994 | Johnson | C10G 5/06 | 62/619 |
| 5,435,436 | A | 7/1995 | Manley et al. | | |
| 5,771,712 | A | 6/1998 | Campbell et al. | | |
| 5,772,733 | A | 6/1998 | Lokhandwala et al. | | |
| 5,799,507 | A * | 9/1998 | Wilkinson et al. | 62/621 | |
| 5,881,569 | A | 3/1999 | Campbell et al. | | |
| 5,960,644 | A * | 10/1999 | Nagelvoort | C10L 3/10 | 62/622 |
| 5,983,664 | A | 11/1999 | Campbell et al. | | |
| 6,112,549 | A | 9/2000 | Yao et al. | | |
| 6,182,469 | B1 | 2/2001 | Campbell et al. | | |
| 6,401,486 | B1 * | 6/2002 | Lee et al. | 62/630 | |
| 6,712,880 | B2 | 3/2004 | Foglietta et al. | | |
| 7,041,156 | B2 * | 5/2006 | Bras et al. | 95/211 | |
| 2002/0065446 | A1 | 5/2002 | Wilkinson et al. | | |
| 2002/0166336 | A1 | 11/2002 | Wilkinson et al. | | |
| 2004/0079107 | A1 * | 4/2004 | Wilkinson et al. | 62/611 | |
| 2004/0187686 | A1 * | 9/2004 | Amin | C10L 3/10 | 95/228 |
| 2005/0092594 | A1 * | 5/2005 | Parro et al. | 203/100 | |
| 2006/0032269 | A1 | 2/2006 | Cuellar et al. | | |
| 2007/0012071 | A1 | 1/2007 | Huang et al. | | |
| 2007/0012072 | A1 | 1/2007 | Qualls et al. | | |
| 2007/0125122 | A1 | 6/2007 | Mak et al. | | |
| 2008/0098770 | A1 | 5/2008 | Ransbarger | | |
| 2008/0115529 | A1 | 5/2008 | Ransbarger et al. | | |
| 2008/0115530 | A1 | 5/2008 | Mock et al. | | |
| 2008/0190136 | A1 | 8/2008 | Pitman et al. | | |
| 2008/0256976 | A1 | 10/2008 | Eaton | | |
| 2008/0264100 | A1 * | 10/2008 | Mak | F25J 3/0214 | 62/618 |
| 2008/0282731 | A1 * | 11/2008 | Cuellar et al. | 62/620 | |
| 2009/0100862 | A1 | 4/2009 | Wilkinson et al. | | |
| 2009/0188279 | A1 | 7/2009 | Bras et al. | | |
| 2009/0277217 | A1 | 11/2009 | Ransbarger et al. | | |
| 2010/0011663 | A1 | 1/2010 | Coyle | | |
| 2010/0011809 | A1 | 1/2010 | Mak | | |
| 2010/0018248 | A1 * | 1/2010 | Fieler | F25J 3/0209 | 62/617 |
| 2010/0031700 | A1 | 2/2010 | Wilkinson et al. | | |
| 2011/0011127 | A1 | 1/2011 | Evans et al. | | |
| 2011/0041550 | A1 * | 2/2011 | Menzel | B01D 3/00 | 62/621 |
| 2011/0120183 | A9 * | 5/2011 | Wilkinson et al. | 62/620 | |
| 2015/0007981 | A1 | 1/2015 | Shomody et al. | | |
| 2015/0153101 | A1 | 6/2015 | Gahier et al. | | |

FOREIGN PATENT DOCUMENTS

| | | | |
|---|---|---|---|
| CA | 2805272 | A1 | 1/2012 |
| DE | 3639555 | A1 | 5/1988 |
| EP | 1008823 | A2 | 6/2000 |
| GB | 2415201 | A | 12/2005 |
| GB | 2462555 | A | 11/2009 |
| WO | 0025061 | A1 | 5/2000 |
| WO | WO 02101307 | A3 * | 12/2002 |
| WO | 2010017061 | A1 | 2/2010 |

OTHER PUBLICATIONS

Foreign Communication From a Counterpart Application, Canadian Application No. 2770658, Canadian Office Action dated Mar. 7, 2014, 2 pages.
Foreign Communication From a Counterpart Application, Canadian Application No. 2770658, Canadian Office Action dated Sep. 30, 2015, 4 pages.
Foreign Communication From a Counterpart Application, Canadian Application No. 2015227466, Canadian Office Action dated Apr. 1, 2016, 4 pages.
Foreign Communication From a Counterpart Application, Australian Application No. 2012201166, Australian Office Action dated Jan. 30, 2015, 4 pages.
Foreign Communication From a Counterpart Application, Australian Application No. 2012201166, Australian Notice of Acceptance dated Oct. 19, 2015, 2 pages.
Foreign Communication From a Counterpart Application, Canadian Application No. 2770658, Canadian Office Action dated Jan. 15, 2015, 3 pages.
Foreign Communication From a Counterpart Application, Canadian Application No. 2770658, Canadian Notice of Allowance dated Oct. 25, 2016, 1 page.
Foreign Communication From a Counterpart Application, Australian Application No. 2015227466, Australian Notice of Acceptance dated Sep. 19, 2016, 2 pages.
Foreign Communication From a Counterpart Application, PCT Application No. PCT/US2016/021022, PCT International Search Report dated Nov. 7, 2016, 5 pages.
Foreign Communication From a Counterpart Application, PCT Application No. PCT/US2016/021022, PCT Written Opinion of the International Searching Authority dated Nov. 7, 2016, 7 pages.
Foreign Communication From a Counterpart Application, PCT Application No. PCT/US2016/021022, PCT Written Opinion of the International Preliminary Examining Authority dated Apr. 12, 2018, 8 pages.
Foreign Communication From a Counterpart Application, Australian Application No. 2016273821, Australian Office Action dated Sep. 17, 2018, 2 pages.
Foreign Communication From a Counterpart Application, Australian Application No. 2016273826, Australian Office Action dated Sep. 20, 2018, 3 pages.
Foreign Communication From a Counterpart Application, Australian Application No. 2016273827, Australian Office Action dated Sep. 27, 2018, 3 pages.
Foreign Communication From a Counterpart Application, Australian Application No. 2016273833, Australian Office Action dated Oct. 26, 2018, 3 pages.
Foreign Communication From a Counterpart Application, Australian Application No. 2016273821, Australian Notice of Acceptance dated May 16, 2019, 3 pages.
Foreign Communication From a Counterpart Application, Australian Application No. 2016273826, Australian Notice of Acceptance dated May 23, 2019, 3 pages.
Foreign Communication From a Counterpart Application, Australian Application No. 2016273827, Australian Notice of Acceptance dated Jun. 7, 2019, 3 pages.
Foreign Communication From a Counterpart Application, Australian Application No. 2016273833, Australian Notice of Acceptance dated Jun. 7, 2019, 3 pages.

* cited by examiner

SINGLE-UNIT GAS SEPARATION PROCESS HAVING EXPANDED, POST-SEPARATION VENT STREAM

CROSS-REFERENCE TO RELATED APPLICATIONS

The present application claims priority to U.S. Provisional Patent Application No. 61/473,315, filed Apr. 8, 2011 by Eric Prim, and entitled "Single-Unit Gas Separation Process Having Expanded, Post-Separation Vent Stream", which is incorporated herein by reference.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Typical gas processing options for high British thermal unit (Btu) gas (i.e. natural gas having a relatively high energy content) include cryogenic processing and refrigeration plants (e.g., a Joule-Thomson (JT) plant, a refrigerated JT plant, or a refrigeration only plant). Cryogenic processes generally comprise a refrigeration step to liquefy some or all of the gas stream followed by a multi-stage separation to remove methane from the liquid products. This process can capture very high (50-95%) ethane percentages, high propane percentages (98-99%), and essentially all (e.g., 100%) of the heavier components. The residual gas from the process will typically have a Btu content meeting a natural gas pipeline specification (e.g. a Btu content of less than about 1,100 Btu/ft$^3$). The liquid product from a cryogenic process can have a high vapor pressure that precludes the liquid from being a truckable product (e.g., a vapor pressure of greater than 250 pounds per square inch gauge (psig)). When a truckable product is required, the liquid product from the cryogenic plant will have to be "de-ethanized" prior to trucking by passing the liquid product through another separation step, and at least some of the ethane can be blended back into the residual gas stream. Cryogenic processes face several constraints and limitations including high capital and operating costs, a high ethane recovery in the liquid product that may make the liquid unmarketable in certain areas, and the requirement for a pipeline to be located nearby.

Refrigeration plants are typically reserved for smaller volumes or stranded assets not near a pipeline. This process generally comprises cooling the inlet gas stream using the JT effect and/or refrigeration followed by a single stage separation. These plants have a lower cost than cryogenic plants, but capture only 30-40% of propane, 80-90% of butanes, and close to 100% of the heavier components. Due to the reduced quantity of light components (e.g., methane and ethane), the liquid product is truckable. However, the lower propane recovery may result in the loss of potentially valuable product and a residual gas product with a high energy content, which can cause the residual gas to exceed the upper limit on the pipeline gas energy content. The reduced propane recovery can also prevent the residual gas from meeting the hydrocarbon dewpoint criteria as set by pipeline operators in certain markets. Additional propane can be recovered from refrigeration plants by increasing the refrigeration duty and/or the pressure drop through the plant, but because the process comprises a single stage, it also causes an increased ethane recovery, which raises the vapor pressure of the liquid product.

In many places, gas is produced that cannot be processed economically under either of the options presented above. The produced gas may have a range of compositions with an energy content ranging from about 1,050 to about 1,700 Btu/ft$^3$ or higher, and may have a nitrogen and/or contaminate (e.g., $CO_2$, $H_2S$, etc.) contents in excess of pipeline specifications. The gas may require a truckable liquid product due to the lack of a natural gas liquids (NGL) pipeline in the vicinity, and the residual gas product can require a high level of propane recovery to meet the energy content specifications of a gas pipeline. Further, the gas may be produced in insufficient quantities to justify the expense of a cryogenic plant.

SUMMARY

In one aspect, the disclosure includes a process comprising separating a hydrocarbon feed stream into a natural gas-rich stream and a liquefied petroleum gas (LPG)-rich stream using process equipment comprising only one multi-stage separation column, wherein the natural gas-rich stream has an energy content of less than or equal to about 1,300 Btu/ft$^3$, and wherein the LPG-rich stream has a vapor pressure less than or equal to about 350 psig.

In another aspect, the disclosure includes a process comprising separating a hydrocarbon feed stream into a top effluent stream and a LPG-rich stream, and subsequently expanding the top effluent stream to produce a natural gas-rich stream.

In another aspect, the disclosure includes an apparatus comprising a multi-stage separation column configured to separate a hydrocarbon feed stream into a natural gas-rich stream and a LPG-rich stream, wherein the natural gas-rich stream has an energy content of less than or equal to about 1,300 Btu/ft$^3$, wherein the LPG-rich stream has a vapor pressure less than or equal to about 350 psig, and wherein the multi-stage separation column is the only multi-stage separation column in the apparatus.

In yet another aspect, the disclosure includes an apparatus comprising a multi-stage separation column configured to separate a hydrocarbon feed stream into a top effluent stream and a LPG-rich stream, and an expander configured to expand the top effluent stream and produce a natural gas-rich stream.

These and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION OF THE PREFERRED EMBODIMENTS

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Disclosed herein is a process and associated process equipment for a gas separation process that may use a single multi-stage column and a partial condensation of the column overhead to produce vapor and liquid portions. The liquid portion may be used as column reflux, while the vapor portion may be expanded and used to cool the column overhead and/or hydrocarbon feed stream. The present process provides a truckable NGL product along with a natural gas product that can be transported through a natural gas pipeline.

Figure 1:
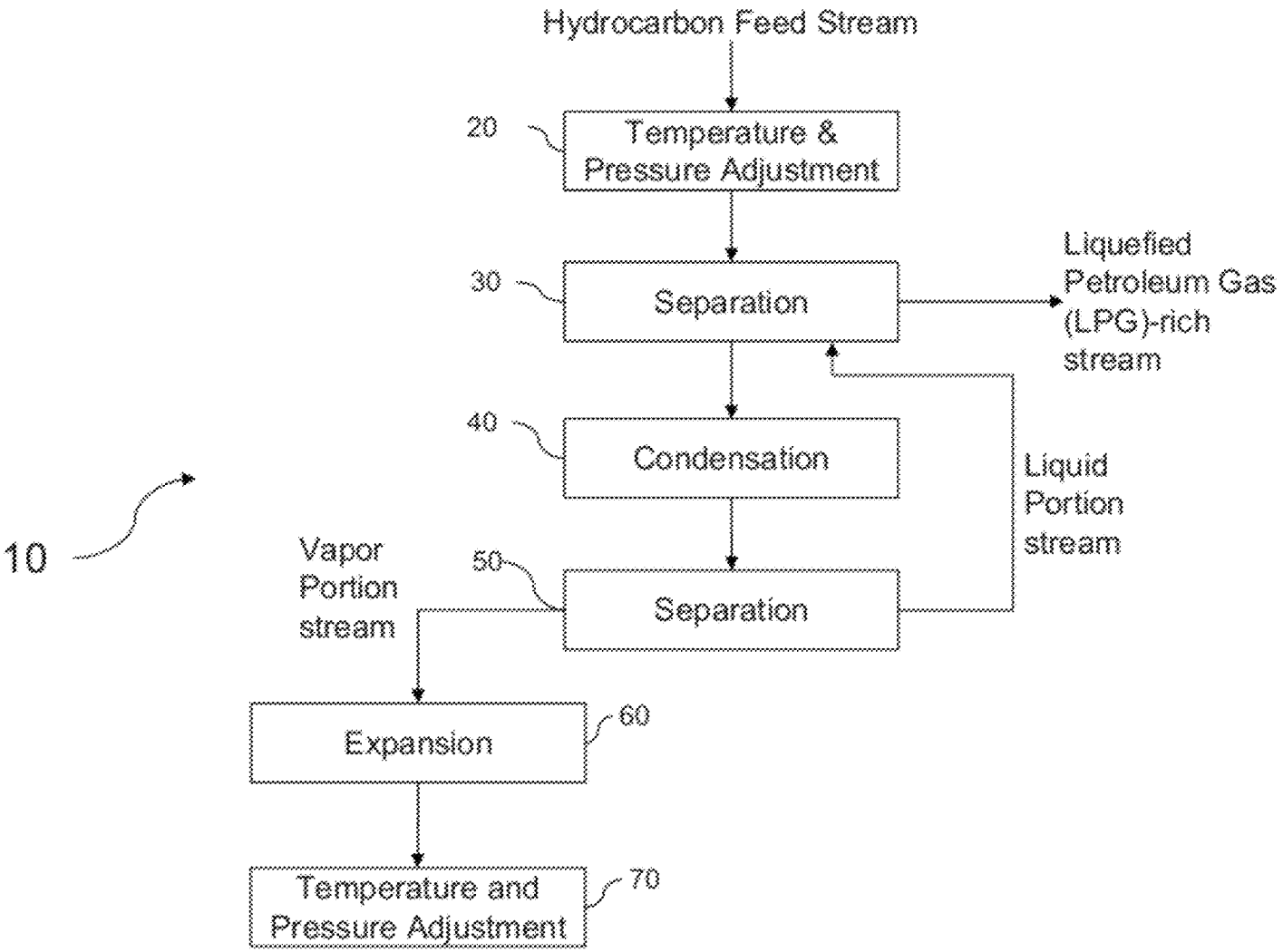
FIG. 1 is a process flow diagram for an embodiment of a single-unit gas separation process having expanded, post-separation vent stream.

FIG. 1 illustrates a process flow diagram of a separation process 10. The gas separation process 10 may receive a hydrocarbon feed stream, which may undergo temperature and/or pressure adjustments 20. The temperature and/or pressure adjustments may include one or more heat exchangers and at least one mechanical refrigeration unit that cool the hydrocarbon fee stream. The heat exchangers may be cross exchangers with the cooled expanded stream from the expansion process 60. The temperature and/or pressure adjustments may reduce the amount of expansion required for the overhead stream to produce the reflux. The hydrocarbon feed stream may then undergo a separation step 30, producing a top effluent stream and a bottom effluent stream. The separation step 30 may occur in the only multi-stage separator in the gas separation process 10. The top effluent stream may undergo a partial condensation step 40 to produce a mixed vapor and liquid stream. The exchanger may be a cross exchanger with the output from the overhead expansion process 60.

The mixed stream may undergo a separation step 50 to produce a liquid portion stream and a vapor portion stream. The liquid portion stream may be recycled to the separation process 30 as reflux. The vapor portion stream formed by the separation process 50 may be cooled by an expansion process 60 (e.g., using a JT expander or an expansion turbine). The expanded overhead stream may undergo further temperature and/or pressure adjustments 70 to create a natural gas-rich stream suitable for entry into a pipeline. Temperature and/or pressure adjustment 70 may comprise any known hydrocarbon temperature and/or pressure adjustment process. For example, the overhead stream may be heated, cooled, compressed, throttled, expanded or combinations thereof. The overhead stream may be cross-exchanged with other streams in the single-unit gas separation process 10 to exchange heat between the streams.

Figure 2:
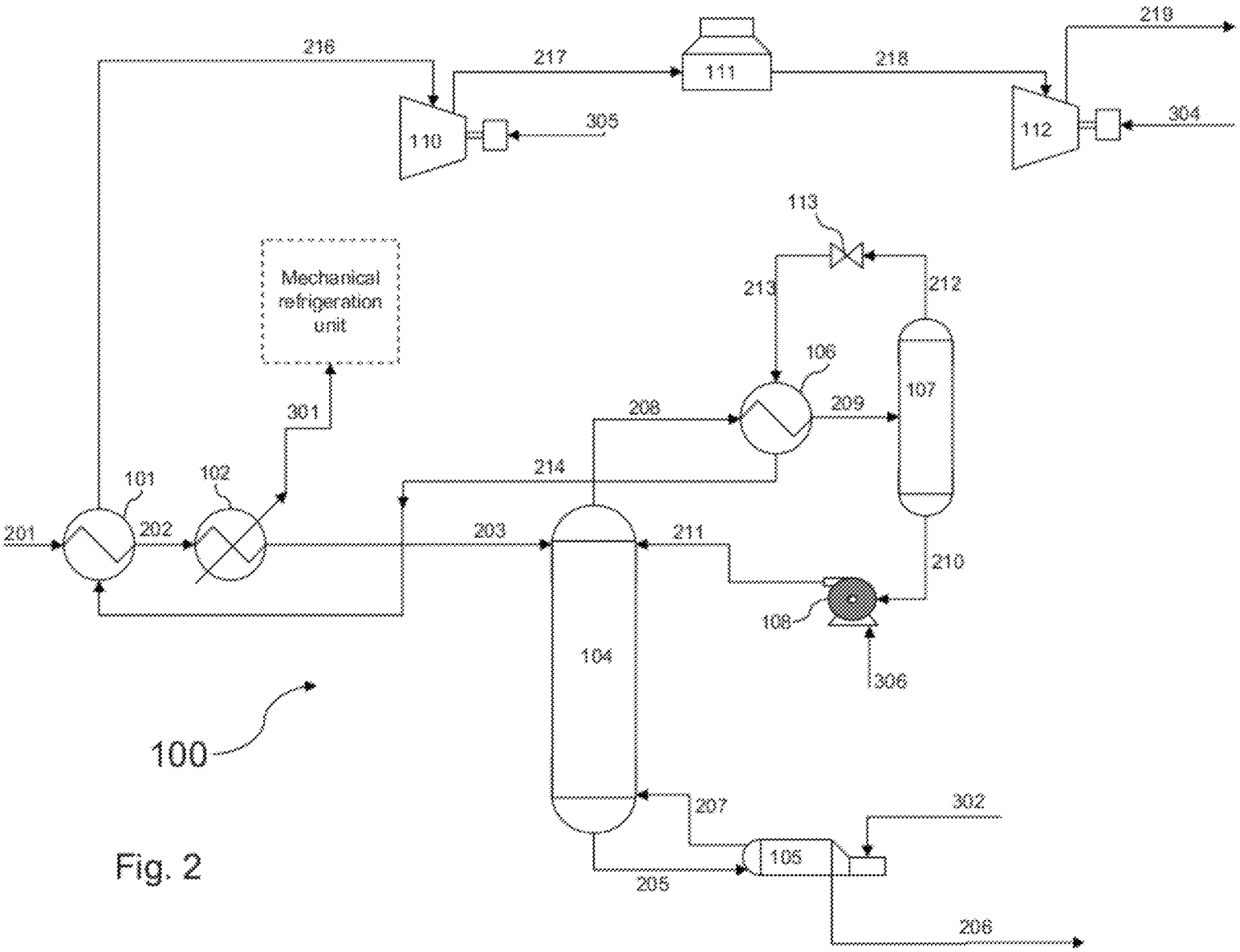
FIG. 2 is a schematic diagram of an embodiment of a single-unit gas separation process having expanded, post-separation vent stream.

FIG. 2 illustrates one embodiment of a gas separation process 100. The gas separation process 100 separates the hydrocarbon feed stream 201 into a LPG-rich stream 206 and a natural gas-rich stream 219, which may be suitable for a gas pipeline. The process 100 receives the hydrocarbon feed stream 201 and may pass the hydrocarbon feed stream 201 through a heat exchanger 101 that uses the overhead stream 214 to reduce the temperature of the hydrocarbon feed stream 201. The cooled feed stream 202 may then pass through a mechanical refrigeration unit 102, which may give off energy 301 to refrigerate the cooled feed stream 202, and produce a refrigerated feed stream 203. The refrigerated feed stream 203 may then be passed to a multi-stage separator column 104, which separates the refrigerated feed stream 203 into a bottom effluent stream 205 and a top effluent stream 208. The bottom effluent stream 205 may be fed into a reboiler 105, which may receive energy 302 by being heated, and which separates the bottom effluent stream 205 into a boil-up stream 207 and the LPG-rich stream 206. The top effluent stream 208 may pass through a heat exchanger 106 cross-exchanged with the expanded overhead stream 213 to at least partially condense the top effluent stream 208, thereby producing a mixed stream 209 comprising liquid and vapor portions. The mixed stream 209 may be fed into the separator 107 that separates the liquid portion stream 210 from the vapor portion stream 212. The liquid portion stream 210 may be passed through pump 108 to control the rate at which reflux stream 211 is fed back into the multi-stage separator column 104.

Returning to the separator 107, the vapor portion stream 212 may be fed into an expander 113, specifically a JT expander, to reduce the temperature and/or pressure of the vapor portion stream 212. The expanded overhead stream 213 may pass through the heat exchanger 106 to increase the temperature of the expanded overhead stream 213 and/or to decrease the temperature of top effluent stream 208. The overhead stream 214 may then be passed through the heat exchanger 101 to further increase the temperature of the overhead stream 214 and/or to cool the hydrocarbon feed stream 201. The residue stream 216 may be passed through a compressor 110 receiving energy 305 to increase the pressure and/or temperature in the residue stream 216 creating the pressurized residue stream 217. The pressurized residue stream 217 may be passed through a heat exchanger 111 to cool the pressurized residue stream 217 creating the cooled pressurized residue stream 218. The cooled pressurized residue stream 218 may be passed through a compressor 112 receiving energy 304 to increase the pressure and/or temperature in the cooled pressurized residue stream 218 to create a natural gas-rich stream 219.

Figure 3:
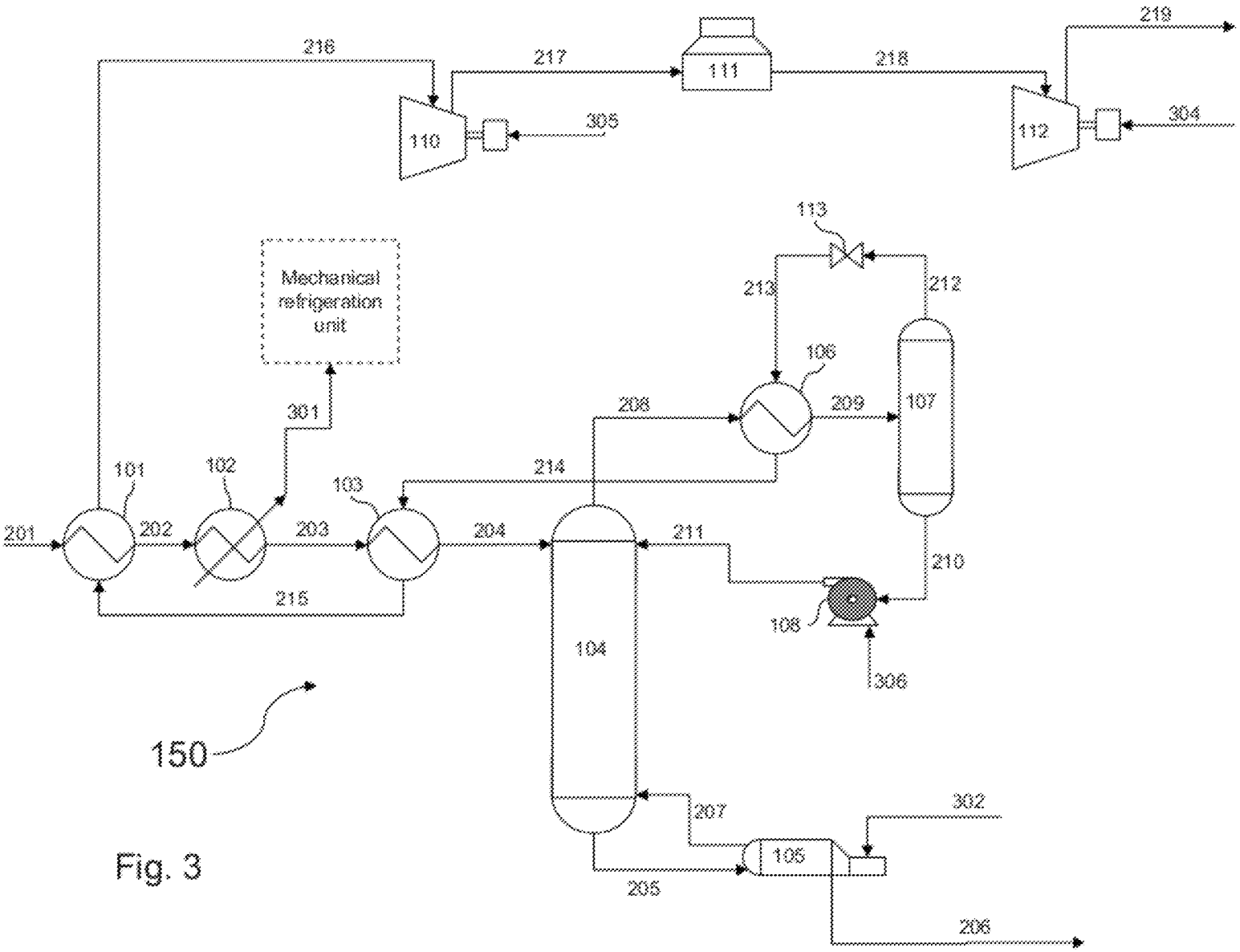
FIG. 3 is a schematic diagram of another embodiment of a single-unit gas separation process having expanded, post-separation vent stream.

FIG. 3 illustrates an embodiment of a gas separation process 150. As in the gas separation process 100 described above, the gas separation process 150 separates the hydrocarbon feed stream 201 into a LPG-rich stream 206 and a natural gas-rich stream 219. The gas separation process 150 receives the hydrocarbon feed stream 201 and may pass the hydrocarbon feed stream 201 through a heat exchanger 101 that uses a warmed residue stream 215 to reduce the temperature of the hydrocarbon feed stream 201, and produce a cooled feed stream 202. The cooled feed stream 202 may then pass through a mechanical refrigeration unit 102, which may give off energy 301 to refrigerate the cooled feed stream 202. The refrigerated feed stream 203 may be passed through a heat exchanger 103 that uses the overhead stream 214 to reduce the temperature of the refrigerated feed stream 203, and produce a chilled feed stream 204. The remaining streams and process equipment in the gas separation process 150 are substantially the same as the corresponding streams and process equipment in the gas separation process 100.

Figure 4:
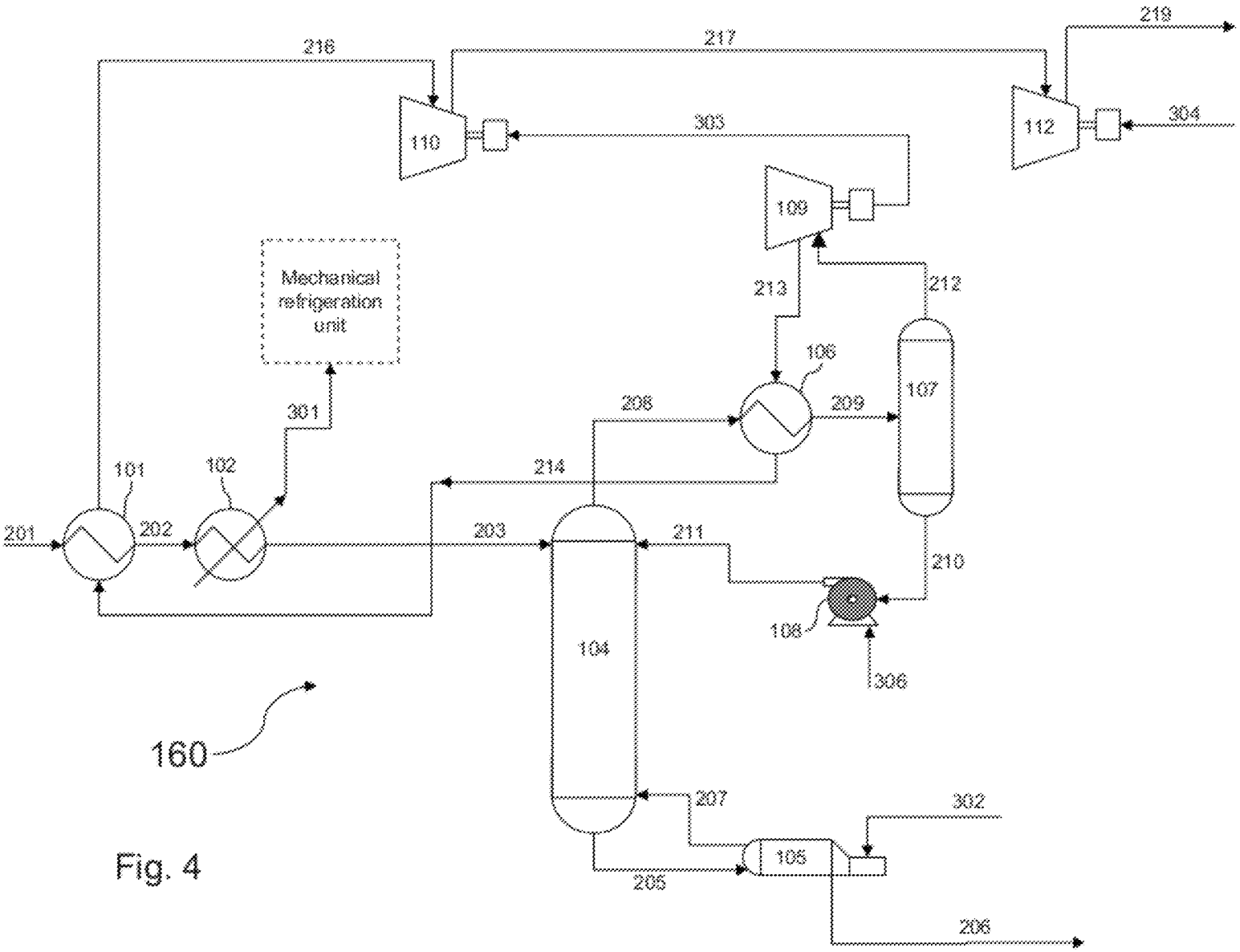
FIG. 4 is a schematic diagram of another embodiment of a single-unit gas separation process having expanded, post-separation vent stream.

FIG. 4 illustrates an embodiment of a gas separation process 160. In the gas separation process 160, the hydrocarbon feed stream 201 may be processed similar to the hydrocarbon feed stream 201 in the gas separation process 100 to create a LPG-rich stream 206 and a vapor portion stream 212. The vapor portion stream 212 may be passed through an expander 109, specifically an expansion turbine, which reduces the temperature and/or pressure of vapor portion stream 212 and produces energy 303 (e.g. mechanical or electrical energy). The expander 109 may be coupled to a compressor 110 such that the energy stream 303 created by the expansion process is used to run the compressor 110. The remaining streams and process equipment in the gas separation process 160 are substantially the same as the corresponding streams and process equipment in the gas separation process 100.

Figure 5:
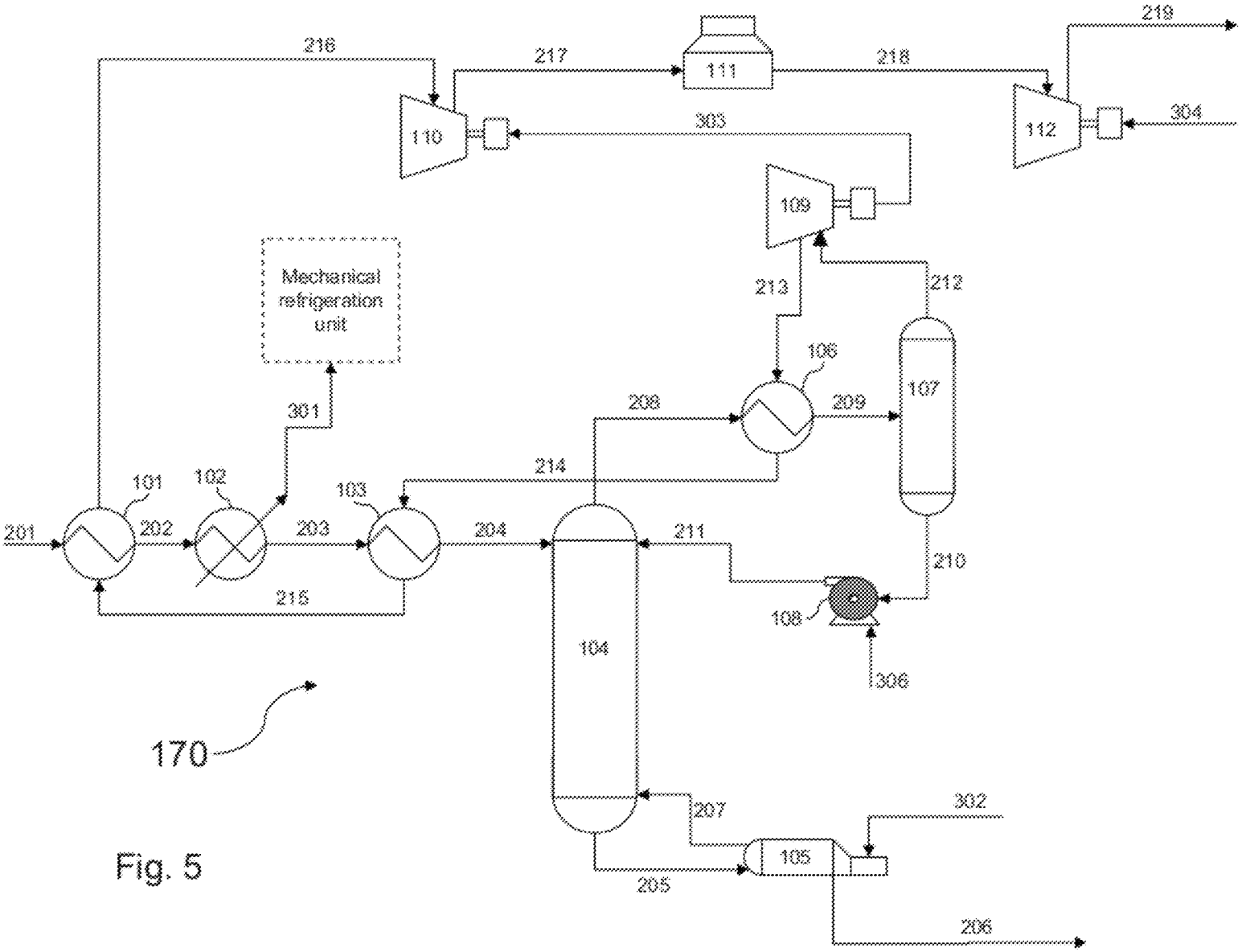
FIG. 5 is a schematic diagram of another embodiment of a single-unit gas separation process having expanded, post-separation vent stream.

FIG. 5 illustrates an embodiment of a gas separation process 170. In the gas separation process 170, the hydrocarbon feed stream 201 may be processed similar to the hydrocarbon feed stream 201 in the gas separation process 150 to produce the LPG-rich stream 206 and a vapor portion stream 212. However, the vapor portion stream 212 may be processed similar to the vapor portion stream 212 in the gas separation process 160 to create a natural-gas rich stream 219. The remaining streams and process equipment in the gas separation process 170 are substantially the same as the corresponding streams and process equipment in the gas separation process 150.

The hydrocarbon feed stream may contain a mixture of hydrocarbons and other compounds. Numerous types of hydrocarbons may be present in the hydrocarbon feed stream, including methane, ethane, propane, i-butane, n-butane, i-pentane, n-pentane, hexane, heptane, octane, and other hydrocarbons. Other compounds may be present in the hydrocarbon feed stream, including nitrogen, carbon dioxide, water, helium, hydrogen sulfide, other acid gases, and/or impurities. The hydrocarbon feed stream may be in any state including a liquid state, a vapor state, or a combination of liquid and vapor states. In an embodiment, the hydrocarbon feed stream may be substantially similar in composition to the hydrocarbons in the subterranean formation, e.g. the hydrocarbons may not be processed prior to entering the gas separation process described herein. Alternatively, the hydrocarbon feed stream may be sweetened, but is not otherwise refined or separated.

The composition of the hydrocarbon feed stream may differ from location to location. In embodiments, the hydrocarbon feed stream comprises from about 45 percent to about 99 percent, from about 60 percent to about 90 percent, or from about 70 percent to about 80 percent methane. Additionally or alternatively, the hydrocarbon feed stream may comprise from about 1 percent to about 25 percent, from about 2 percent to about 18 percent, or from about 4 percent to about 12 percent ethane. Additionally or alternatively, the hydrocarbon feed stream may comprise from about 1 percent to about 25 percent, from about 2 percent to about 20 percent, or from about 3 percent to about 9 percent propane. In embodiments, the hydrocarbon feed stream may have an energy content of less than or equal to about 2,000 Btu/ft$^3$, from about 900 Btu/ft$^3$ to about 1,800 Btu/ft$^3$, or from about 1,100 Btu/ft$^3$ to about 1,600 Btu/ft$^3$. Unless otherwise stated, the percentages herein are provided on a mole basis.

The LPG-rich stream may contain a mixture of hydrocarbons and other compounds. Numerous types of hydrocarbons may be present in the LPG-rich stream, including methane, ethane, propane, i-butane, n-butane, i-pentane, n-pentane, hexane, heptane, octane, and other hydrocarbons. Other compounds may be present in the LPG-rich stream, including nitrogen, carbon dioxide, water, helium, hydrogen sulfide, other acid gases, and/or other impurities. Specifically, the LPG-rich stream comprises less than or equal to about 6 percent, less than or equal to about 4 percent, less than or equal to about 2 percent, or is substantially free of methane. Additionally or alternatively, the LPG-rich stream may comprise from about 8 percent to about 35 percent, from about 10 percent to about 28 percent, or from about 15 percent to about 25 percent ethane. Additionally or alternatively, the LPG-rich stream may comprise from about 10 percent to about 60 percent, from about 20 percent to about 50 percent, or from about 24 percent to about 33 percent propane. In embodiments, the LPG-rich stream may have a vapor pressure less than or equal to about 600 psig, less than or equal to about 250 psig, or less than or equal to about 200 psig, which may be determined according to ASTM-D-323.

In embodiments, the LPG-rich stream may contain an increased propane concentration and a decreased methane concentration compared to the hydrocarbon feed stream. In embodiments, the LPG-rich stream may comprise less than or equal to about 15 percent, less than or equal to about 7 percent, or less than or equal to about 3 percent of the methane in the hydrocarbon feed stream. Additionally or alternatively, the LPG-rich stream may comprise from about 10 percent to about 55 percent, from about 20 percent to about 53 percent, or from about 40 percent to about 50 percent of the ethane in the hydrocarbon feed stream. Additionally or alternatively, the LPG-rich stream may comprise greater than or equal to about 40 percent, greater than or equal to about 60 percent, or greater than or equal to about 85 percent of the propane in the hydrocarbon feed stream.

The natural gas-rich stream may contain a mixture of hydrocarbons and other compounds. Numerous types of hydrocarbons may be present in the natural gas-rich stream, including methane, ethane, propane, i-butane, n-butane, i-pentane, n-pentane, hexane, heptane, octane, and other hydrocarbons. Other compounds may be present in the natural gas-rich stream, including nitrogen, carbon dioxide, water, helium, hydrogen sulfide, other acid gases, and/or other impurities. Specifically, the natural gas-rich stream comprises greater than or equal to about 65 percent, from about 75 percent to about 99 percent, or from about 85 percent to about 95 percent methane. Additionally or alternatively, the natural gas-rich stream may comprise less than about 30 percent, from about 1 percent to about 20 percent, or from about 2 percent to about 8 percent ethane. Additionally or alternatively, the natural gas-rich stream may be less than about 1 percent or be substantially free of propane. In embodiments, the natural gas-rich stream may have an energy content of less than or equal to about 1,300 Btu/ft$^3$, from about 900 Btu/ft$^3$ to about 1,200 Btu/ft$^3$, from about 950 Btu/ft$^3$ to about 1,150 Btu/ft$^3$, or from about 1,000 Btu/ft$^3$ to about 1,100 Btu/ft$^3$.

In embodiments, the natural gas-rich stream may contain an increased methane concentration and a decreased propane concentration compared to the hydrocarbon feed stream 201. In embodiments, the natural gas-rich stream may contain greater than or equal to about 85 percent, greater than or equal to about 93 percent, or greater than or equal to about 97 percent of the methane in the hydrocarbon feed stream.

Additionally or alternatively, the natural gas-rich stream may comprise from about 45 percent to about 90 percent, from about 47 percent to about 80 percent, or from about 50 percent to about 60 percent of the ethane in the hydrocarbon feed stream. Additionally or alternatively, the natural gas-rich stream may comprise less than or equal to about 60 percent, less than or equal to about 40 percent, or less than or equal to about 15 percent of the propane in the hydrocarbon feed stream.

The separators described herein may be any of a variety of process equipment suitable for separating a stream into two separate streams having different compositions, states, temperatures, and/or pressures. At least one of the separators may be a multi-stage separation column, in which the separation process occurs at multiple stages having unique temperature and pressure gradients. A multi-stage separation column may be a column having trays, packing, or some other type of complex internal structure. Examples of such columns include scrubbers, strippers, absorbers, adsorbers, packed columns, and distillation columns having valve, sieve, or other types of trays. Such columns may employ weirs, downspouts, internal baffles, temperature, and/or pressure control elements. Such columns may also employ some combination of reflux condensers and/or reboilers, including intermediate stage condensers and reboilers. Additionally or alternatively, one or more of the separators may be a single stage separation column such as a phase separator. A phase separator is a vessel that separates an inlet stream into a substantially vapor stream and a substantially liquid stream without a substantial change between the state of the feed entering the vessel and the state of the fluids inside the vessel. Such vessels may have some internal baffles, temperature, and/or pressure control elements, but generally lack any trays or other type of complex internal structure commonly found in columns. For example, the phase separator may be a knockout drum or a flash drum. Finally, one or more of the separators may be any other type of separator, such as a membrane separator.

The expanders described herein may be any of a variety of process equipment capable of cooling a gas stream. For example, the expanders may be a JT expander, e.g. any device that cools a stream primarily using the JT effect, such as throttling devices, throttling valves, or a porous plug. Alternatively, the expanders may be expansion turbines. Generally, expansion turbines, also called turboexpanders, include a centrifugal or axial flow turbine connected to a drive a compressor or an electric generator. The types of expansion turbines suitable include turboexpanders, centrifugal or axial flow turbines.

The heat exchangers described herein may be any of a variety of process equipment suitable for heating or cooling any of the streams described herein. Generally, heat exchangers are relatively simple devices that allow heat to be exchanged between two fluids without the fluids directly contacting each other. In the case of an air cooler, one of the fluids is atmospheric air, which may be forced over tubes or coils using one or more fans. The types of heat exchangers suitable for the gas separation process include shell and tube, kettle-type, air-cooled, bayonet, plate-fin, and spiral heat exchangers.

The mechanical refrigeration unit described herein may be any of a variety of process equipment comprising a suitable refrigeration process. The refrigeration fluid that circulates in the mechanical refrigeration unit may be any suitable refrigeration fluid, such as methane, ethane, propane, FREON, or combinations thereof.

The reboiler described herein may be any of a variety of process equipment suitable for changing the temperature and or separating any of the streams described herein. In embodiments, the reboiler may be any vessel that separates an inlet stream into a substantially vapor stream and a substantially liquid stream. These vessels typically have some internal baffles, temperature, and/or pressure control elements, but generally lack any trays or other type of complex internal structure found in other vessels. In specific embodiments, heat exchangers and kettle-type reboilers may be used as the reboilers described herein.

The compressors described herein may be any of a variety of process equipment suitable for increasing the pressure, temperature, and/or density of any of the streams described herein. Generally, compressors are associated with vapor streams; however, such a limitation should not be read into the present processes as the compressors described herein may be interchangeable with pumps based upon the specific conditions and compositions of the streams. The types of compressors and pumps suitable for the uses described herein include centrifugal, axial, positive displacement, rotary and reciprocating compressors and pumps. Finally, the gas separation processes described herein may contain additional compressors and/or pumps other than those described herein.

The pump described herein may be any of a variety of process equipment suitable for increasing the pressure, temperature, and/or density of any of the streams described herein. The types of pumps suitable for the uses described herein include centrifugal, axial, positive displacement, rotary, and reciprocating pumps. Finally, the gas separation processes described herein may contain additional pumps other than those described herein.

The energy streams described herein may be derived from any number of suitable sources. For example, heat may be added to a process stream using steam, turbine exhaust, or some other hot fluid and a heat exchanger. Similarly, heat may be removed from a process stream by using a refrigerant, air, or some other cold fluid and a heat exchanger. Further, electrical energy can be supplied to compressors, pumps, and other mechanical equipment to increase the pressure or other physical properties of a fluid. Similarly, turbines, generators, or other mechanical equipment can be used to extract physical energy from a stream and optionally convert the physical energy into electrical energy. Persons of ordinary skill in the art are aware of how to configure the processes described herein with the required energy streams. In addition, persons of ordinary skill in the art will appreciate that the gas separation processes described herein may contain additional equipment, process streams, and/or energy streams other than those described herein.

The gas separation process having an expanded, post-separation vent stream described herein has many advantages. One advantage is the use of only one multi-stage separator column. This is an advantage because it reduces the capital costs of building and operating the process. A second advantage is the process produces both a truckable LPG-rich stream and a pipeline suitable natural gas-rich stream. When combined with heat integration, the process may be able to recover a high percentage (e.g., about 85 to about 98%) of the propane in the LPG-rich stream while rejecting enough ethane to make a truckable product (e.g., a vapor pressure less than about 350 psig) as well as meet pipeline specifications on the natural gas-rich stream (e.g., a heat content of less than about 1,100 Btu/ft$^3$, a dew point specification, etc.).

Examples

In one example, a process simulation was performed using the single-unit gas separation process 100 shown in FIG. 2. The simulation was performed using the Aspen HYSYS Version 7.2 software package. The material streams, their compositions, and the associated energy streams produced by the simulation are provided in Tables 1-3 below. The specified values are indicated by an asterisk (*). The physical properties are provided in degrees Fahrenheit (F), pounds per square inch gauge (psig), million standard cubic feet per day (MMSCFD), pounds per hour (lb/hr), barrels per day (barrel/day), Btu/ft$^3$, and Btu/hr.

TABLE 1A

FIG. 2 Single-Unit Gas Separator Stream Properties

| Property | 201 | 202 | 203 | 206 | 208 |
|---|---|---|---|---|---|
| Vapor Fraction | 0.9365 | 0.8579 | 0.7091 | 0.0005 | 1 |
| Temperature (F.) | 100* | 50.79 | −20 | 253.1 | −48.66 |
| Pressure (psig) | 800* | 795 | 790 | 705 | 700 |
| Molar Flow (MMSCFD) | 25* | 25 | 25 | 4.739 | 23.97 |
| Mass Flow (lb/hr) | 65540 | 65540 | 65540 | 26920 | 47600 |
| Liquid Vol. Flow (barrel/day) | 11850 | 11850 | 11850 | 3457 | 10150 |
| Heat Flow (Btu/hr) | −1.01E+08 | −1.04E+08 | −1.08E+08 | −2.72E+07 | −9.17E+07 |

TABLE 1B

FIG. 2 Single-Unit Gas Separator Stream Properties

| Property | 209 | 210 | 211 | 212 | 213 |
|---|---|---|---|---|---|
| Vapor Fraction | 0.8466 | 0 | 0 | 1 | 0.9473 |
| Temperature (F.) | −80.76 | −80.59 | −78.76 | −80.59 | −136.7 |
| Pressure (psig) | 695 | 695 | 795 | 695 | 200 |
| Molar Flow (MMSCFD) | 23.97 | 3.705 | 3.705 | 20.17 | 20.17 |
| Mass Flow (lb/hr) | 47600 | 8980 | 8980 | 38480 | 38480 |
| Liquid Vol. Flow (barrel/day) | 10150 | 1757 | 1757 | 8359 | 8359 |
| Heat Flow (Btu/hr) | −9.38E+07 | −1.64E+07 | −1.64E+07 | −7.71E+07 | −7.71E+07 |

TABLE 1C

FIG. 2 Single-Unit Gas Separator Stream Properties

| Property | 214 | 216 | 217 | 218 | 219 |
|---|---|---|---|---|---|
| Vapor Fraction | 1 | 1 | 1 | 1 | 1 |
| Temperature (F.) | −60 | 80 | 150.2 | 120 | 293.7 |
| Pressure (psig) | 195 | 192 | 300 | 295 | 800 |
| Molar Flow (MMSCFD) | 20.17 | 20.17 | 20.17 | 20.17 | 21.17 |
| Mass Flow (lb/hr) | 38480 | 38480 | 38480 | 38480 | 38480 |
| Liquid Vol. Flow (barrel/day) | 8359 | 8359 | 8359 | 8359 | 8359 |
| Heat Flow (Btu/hr) | −7.49E+07 | −7.21E+07 | −7.07E+07 | −7.14E+07 | −6.79E+07 |

TABLE 1D

FIG. 2 Single-Unit Gas Separator Stream Properties

| | 201 | 206 | 219 |
|---|---|---|---|
| Energy Content (Btu/ft$^3$) | 1395.72 | | 1043.91 |
| Vapor Pressure (psig) | | 250 | |

TABLE 2A

FIG. 2 Single-Unit Gas Separator Stream Compositions

| Mole Frac | 201 | 202 | 203 | 206 | 208 | 209 | 210 | 211 |
|---|---|---|---|---|---|---|---|---|
| Nitrogen | 0.0162* | 0.0162 | 0.0162 | 0.0000 | 0.0178 | 0.0178 | 0.0059 | 0.0059 |
| $CO_2$ | 0.0041* | 0.0041 | 0.0041 | 0.0040 | 0.0047 | 0.0047 | 0.0075 | 0.0075 |
| Methane | 0.7465* | 0.7465 | 0.7465 | 0.0220 | 0.8807 | 0.8807 | 0.6878 | 0.6878 |
| Ethane | 0.0822* | 0.0822 | 0.0822 | 0.2120 | 0.0739 | 0.0739 | 0.1944 | 0.1944 |
| Propane | 0.0608* | 0.0608 | 0.0608 | 0.2881 | 0.0216 | 0.0216 | 0.0980 | 0.0980 |
| i-Butane | 0.0187* | 0.0187 | 0.0187 | 0.0972 | 0.0008 | 0.0008 | 0.0035 | 0.0035 |
| n-Butane | 0.0281* | 0.0281 | 0.0281 | 0.1477 | 0.0005 | 0.0005 | 0.0026 | 0.0026 |

TABLE 2A-continued

| FIG. 2 Single-Unit Gas Separator Stream Compositions | | | | | | | | |
|---|---|---|---|---|---|---|---|---|
| Mole Frac | 201 | 202 | 203 | 206 | 208 | 209 | 210 | 211 |
| i-Pentane | 0.015* | 0.0150 | 0.0150 | 0.0791 | 0.0000 | 0.0000 | 0.0002 | 0.0002 |
| n-Pentane | 0.0169* | 0.0169 | 0.0169 | 0.0892 | 0.0000 | 0.0000 | 0.0001 | 0.0001 |
| Hexane | 0.006* | 0.0060 | 0.0060 | 0.0317 | 0.0000 | 0.0000 | 0.0000 | 0.0000 |
| Heptane | 0.004* | 0.0040 | 0.0040 | 0.0211 | 0.0000 | 0.0000 | 0.0000 | 0.0000 |
| Octane | 0.0015* | 0.0015 | 0.0015 | 0.0079 | 0.0000 | 0.0000 | 0.0000 | 0.0000 |
| Water | 0* | 0.0000 | 0.0000 | 0.0000 | 0.0000 | 0.0000 | 0.0000 | 0.0000 |
| $H_2S$ | 0* | 0.0000 | 0.0000 | 0.0000 | 0.0000 | 0.0000 | 0.0000 | 0.0000 |

TABLE 2B

| FIG. 2 Single-Unit Gas Separator Stream Compositions | | | | | | | |
|---|---|---|---|---|---|---|---|
| Mole Frac | 212 | 213 | 214 | 216 | 217 | 218 | 219 |
| Nitrogen | 0.0200 | 0.0200 | 0.0200 | 0.0200 | 0.0200 | 0.0200 | 0.0200 |
| $CO_2$ | 0.0041 | 0.0041 | 0.0041 | 0.0041 | 0.0041 | 0.0041 | 0.0041 |
| Methane | 0.9152 | 0.9152 | 0.9152 | 0.9152 | 0.9152 | 0.9152 | 0.9152 |
| Ethane | 0.0521 | 0.0521 | 0.0521 | 0.0521 | 0.0521 | 0.0521 | 0.0521 |
| Propane | 0.0084 | 0.0084 | 0.0084 | 0.0084 | 0.0084 | 0.0084 | 0.0084 |
| i-Butane | 0.0001 | 0.0001 | 0.0001 | 0.0001 | 0.0001 | 0.0001 | 0.0001 |
| n-Butane | 0.0001 | 0.0001 | 0.0001 | 0.0001 | 0.0001 | 0.0001 | 0.0001 |
| i-Pentane | 0.0000 | 0.0000 | 0.0000 | 0.0000 | 0.0000 | 0.0000 | 0.0000 |
| n-Pentane | 0.0000 | 0.0000 | 0.0000 | 0.0000 | 0.0000 | 0.0000 | 0.0000 |
| Hexane | 0.0000 | 0.0000 | 0.0000 | 0.0000 | 0.0000 | 0.0000 | 0.0000 |
| Heptane | 0.0000 | 0.0000 | 0.0000 | 0.0000 | 0.0000 | 0.0000 | 0.0000 |
| Octane | 0.0000 | 0.0000 | 0.0000 | 0.0000 | 0.0000 | 0.0000 | 0.0000 |
| Water | 0.0000 | 0.0000 | 0.0000 | 0.0000 | 0.0000 | 0.0000 | 0.0000 |
| $H_2S$ | 0.0000 | 0.0000 | 0.0000 | 0.0000 | 0.0000 | 0.0000 | 0.0000 |

TABLE 3

| FIG. 2 Single-Unit Gas Separator Energy Streams | | | | | |
|---|---|---|---|---|---|
| Energy Flow | 301 | 302 | 304 | 305 | 306 |
| Btu/hr | 4,119,000 | 5,822,000 | 3,526,000 | 1,349,000 | 9,863 |

A second process simulation was performed using the single-unit gas separation process 100 shown in FIG. 2. The simulation was performed using the Aspen HYSYS Version 7.2 software package. This second simulation was run with a different feed composition. The material streams, their compositions, and the associated energy streams produced by the simulation are provided in Tables 4-6 below. The specified values are indicated by an asterisk (*). The physical properties are provided in degrees F., psig, MMSCFD, lb/hr, barrel/day, Btu/ft$^3$, and Btu/hr.

TABLE 4A

| FIG. 2 Single-Unit Gas Separator Stream Properties | | | | | |
|---|---|---|---|---|---|
| Property | 201 | 202 | 203 | 206 | 208 |
| Vapor Fraction | 0.9219 | 0.8576 | 0.5038 | 0 | 1 |
| Temperature (F.) | 100* | 82.57 | −20 | 168.6 | −8.961 |
| Pressure (psig) | 400* | 395 | 390 | 405 | 400 |
| Molar Flow (MMSCFD) | 1* | 1 | 1 | 0.3496 | 0.6786 |
| Mass Flow (lb/hr) | 3299 | 3299 | 3299 | 1845 | 1564 |
| Liquid Vol. Flow (barrel/day) | 531.6 | 531.6 | 531.6 | 245.4 | 303.1 |
| Heat Flow (Btu/hr) | −4.372E+06 | −4.440E+06 | −4.811E+06 | −2.021E+06 | −2.649E+06 |

TABLE 4B

| FIG. 2 Single-Unit Gas Separator Stream Properties | | | | | |
|---|---|---|---|---|---|
| Property | 209 | 210 | 211 | 212 | 213 |
| Vapor Fraction | 0.9584 | 0 | 0 | 1 | 1 |
| Temperature (F.) | −24.54 | −24.51 | −23.4 | −24.51 | −61.48 |
| Pressure (psig) | 395 | 395 | 495 | 395 | 100 |
| Molar Flow (MMSCFD) | 0.6786 | 0.02819 | 0.002819 | 0.6502 | 0.6502 |
| Mass Flow (lb/hr) | 1564 | 110 | 110 | 1454 | 1454 |
| Liquid Vol. Flow (barrel/day) | 303.1 | 17.02 | 17.02 | 286.1 | 286.1 |
| Heat Flow (Btu/hr) | −2.677E+06 | −1.540E+05 | −1.539E+05 | −2.52E+06 | −2.52E+06 |

TABLE 4C

FIG. 2 Single-Unit Gas Separator Stream Properties

| Property | 214 | 216 | 217 | 218 | 219 |
|---|---|---|---|---|---|
| Vapor Fraction | 1 | 1 | 1 | 1 | 1 |
| Temperature (F.) | −20 | 80 | 251.3 | 120 | 232.3 |
| Pressure (psig) | 95 | 92 | 300 | 295 | 600 |
| Molar Flow (MMSCFD) | 0.6502 | 0.6502 | 0.6502 | 0.6502 | 0.6502 |
| Mass Flow (lb/hr) | 1454 | 1454 | 1454 | 1454 | 1454 |
| Liquid Vol. Flow (barrel/day) | 286.1 | 286.1 | 286.1 | 286.1 | 286.1 |
| Heat Flow (Btu/hr) | −2.49E+06 | −2.43E+06 | −2.31E+06 | −2.41E+06 | −2.33E+06 |

TABLE 4D

FIG. 2 Single-Unit Gas Separator Stream Properties

| | 201 | 206 | 219 |
|---|---|---|---|
| Energy Content (Btu/ft$^3$) | 1682.1 | | 1123.9 |
| Vapor Pressure (psig) | | 200 | |

TABLE 5A

FIG. 2 Single-Unit Gas Separator Stream Properties

| Mole Frac | 201 | 202 | 203 | 206 | 208 | 209 | 210 | 211 |
|---|---|---|---|---|---|---|---|---|
| Nitrogen | 0.032* | 0.0320 | 0.0320 | 0.0000 | 0.0473 | 0.0473 | 0.0039 | 0.0039 |
| $CO_2$ | 0.0102* | 0.0102 | 0.0102 | 0.0008 | 0.0151 | 0.0151 | 0.0118 | 0.0118 |
| Methane | 0.4896* | 0.4896 | 0.4896 | 0.0009 | 0.7296 | 0.7296 | 0.2056 | 0.2056 |
| Ethane | 0.1486* | 0.1486 | 0.1486 | 0.1743 | 0.1412 | 0.1412 | 0.2871 | 0.2871 |
| Propane | 0.1954* | 0.1954 | 0.1954 | 0.4762 | 0.0593 | 0.0593 | 0.3995 | 0.3995 |
| i-Butane | 0.0692* | 0.0692 | 0.0692 | 0.1916 | 0.0065 | 0.0065 | 0.0778 | 0.0778 |
| n-Butane | 0.0285* | 0.0285 | 0.0285 | 0.0806 | 0.0011 | 0.0011 | 0.0140 | 0.0140 |
| i-Pentane | 0.0102* | 0.0102 | 0.0102 | 0.0291 | 0.0000 | 0.0000 | 0.0001 | 0.0001 |
| n-Pentane | 0.0102* | 0.0102 | 0.0102 | 0.0291 | 0.0000 | 0.0000 | 0.0001 | 0.0001 |
| Hexane | 0.002* | 0.0020 | 0.0020 | 0.0058 | 0.0000 | 0.0000 | 0.0000 | 0.0000 |
| Heptane | 0.002* | 0.0020 | 0.0020 | 0.0058 | 0.0000 | 0.0000 | 0.0000 | 0.0000 |
| Octane | 0.002* | 0.0020 | 0.0020 | 0.0058 | 0.0000 | 0.0000 | 0.0000 | 0.0000 |
| Water | 0* | 0.0000 | 0.0000 | 0.0000 | 0.0000 | 0.0000 | 0.0000 | 0.0000 |
| $H_2S$ | 0* | 0.0000 | 0.0000 | 0.0000 | 0.0000 | 0.0000 | 0.0000 | 0.0000 |

TABLE 5B

FIG. 2 Single-Unit Gas Separator Stream Properties

| Mole Frac | 212 | 213 | 214 | 216 | 217 | 218 | 219 |
|---|---|---|---|---|---|---|---|
| Nitrogen | 0.0491 | 0.0491 | 0.0491 | 0.0491 | 0.0491 | 0.0491 | 0.0491 |
| $CO_2$ | 0.0152 | 0.0152 | 0.0152 | 0.0152 | 0.0152 | 0.0152 | 0.0152 |
| Methane | 0.7515 | 0.7515 | 0.7515 | 0.7515 | 0.7515 | 0.7515 | 0.7515 |
| Ethane | 0.1355 | 0.1355 | 0.1355 | 0.1355 | 0.1355 | 0.1355 | 0.1355 |
| Propane | 0.0451 | 0.0451 | 0.0451 | 0.0451 | 0.0451 | 0.0451 | 0.0451 |
| i-Butane | 0.0032 | 0.0032 | 0.0032 | 0.0032 | 0.0032 | 0.0032 | 0.0032 |
| n-Butane | 0.0004 | 0.0004 | 0.0004 | 0.0004 | 0.0004 | 0.0004 | 0.0004 |
| i-Pentane | 0.0000 | 0.0000 | 0.0000 | 0.0000 | 0.0000 | 0.0000 | 0.0000 |
| n-Pentane | 0.0000 | 0.0000 | 0.0000 | 0.0000 | 0.0000 | 0.0000 | 0.0000 |
| Hexane | 0.0000 | 0.0000 | 0.0000 | 0.0000 | 0.0000 | 0.0000 | 0.0000 |
| Heptane | 0.0000 | 0.0000 | 0.0000 | 0.0000 | 0.0000 | 0.0000 | 0.0000 |
| Octane | 0.0000 | 0.0000 | 0.0000 | 0.0000 | 0.0000 | 0.0000 | 0.0000 |
| Water | 0.0000 | 0.0000 | 0.0000 | 0.0000 | 0.0000 | 0.0000 | 0.0000 |
| $H_2S$ | 0.0000 | 0.0000 | 0.0000 | 0.0000 | 0.0000 | 0.0000 | 0.0000 |

TABLE 6

FIG. 2 Single-Unit Gas Separator Stream Properties

| Energy Flow | 301 | 302 | 304 | 305 | 306 |
|---|---|---|---|---|---|
| Btu/hr | 370,100 | 295,000 | 76,450 | 120,400 | 86 |

In another example, a process simulation was performed using the single-unit gas separation process 150 shown in FIG. 3. The simulation was performed using the Aspen HYSYS Version 7.2 software package. The material streams, their compositions, and the associated energy streams produced by the simulation are provided in Tables 7-9 below. The specified values are indicated by an asterisk (*). The physical properties are provided in degrees F., psig, MMSCFD, Btu/ft$^3$, and Btu/hr.

TABLE 7A

FIG. 3 Single-Unit Gas Separator Stream Properties

| Property | 201 | 202 | 203 | 204 | 206 | 208 |
|---|---|---|---|---|---|---|
| Vapor Fraction | 0.9347 | 0.8577 | 0.7151 | 0.7109 | 0 | 1 |
| Temperature (F.) | 100* | 52.44 | −15 | −17 | 256.3 | −43.21 |
| Pressure (psig) | 800* | 795 | 790 | 785 | 710 | 700 |
| Molar Flow (MMSCFD) | 25* | 25 | 25 | 25 | 4.649 | 23.59 |
| Mass Flow (lb/hr) | 65540 | 65540 | 65540 | 65540 | 26550 | 47110 |
| Liquid Vol. Flow (barrel/day) | 11850 | 11850 | 11850 | 11850 | 3397 | 10010 |
| Heat Flow (Btu/hr) | −1.01E+08 | −1.04E+08 | −1.08E+08 | −1.08E+08 | −2.67E+07 | −9.02E+07 |

TABLE 7B

FIG. 3 Single-Unit Gas Separator Stream Properties

| Property | 209 | 210 | 211 | 212 | 213 | 214 |
|---|---|---|---|---|---|---|
| Vapor Fraction | 0.8632 | 0 | 0 | 1 | 0.9532 | 1 |
| Temperature (F.) | −76.43 | −76.56 | −74.79 | −76.56 | −132 | −58 |
| Pressure (psig) | 695 | 695 | 795 | 695 | 200 | 195 |
| Molar Flow (MMSCFD) | 23.59 | 3.237 | 3.237 | 20.36 | 20.36 | 20.36 |
| Mass Flow (lb/hr) | 47110 | 8118 | 8118 | 38990 | 38990 | 38990 |
| Liquid Vol. Flow (barrel/day) | 10010 | 1559 | 1559 | 8453 | 8453 | 8453 |
| Heat Flow (Btu/hr) | −9.22E+07 | −1.45E+07 | −1.45E+07 | −7.77E+07 | −7.77E+07 | −7.57E+07 |

TABLE 7C

FIG. 3 Single-Unit Gas Separator Stream Properties

| Property | 215 | 216 | 217 | 218 | 219 |
|---|---|---|---|---|---|
| Vapor Fraction | 1 | 1 | 1 | 1 | 1 |
| Temperature (F.) | −53.46 | 80 | 222.2 | 120 | 221 |
| Pressure (psig) | 190 | 187 | 450 | 445 | 800 |
| Molar Flow (MMSCFD) | 20.36 | 20.36 | 20.36 | 20.36 | 20.36 |
| Mass Flow (lb/hr) | 38990 | 38990 | 38990 | 38990 | 38990 |
| Liquid Vol. Flow (barrel/day) | 8453 | 8453 | 8453 | 8453 | 8453 |
| Heat Flow (Btu/hr) | −7.55E+07 | −7.28E+07 | −7.00E+07 | 7.23E+07 | −7.03E+07 |

TABLE 7D

FIG. 3 Single-Unit Gas Separator Stream Properties

| | 201 | 206 | 219 |
|---|---|---|---|
| Energy Content (Btu/ft$^3$) | 1395.7 | | 1042.3 |
| Vapor Pressure (psig) | | 250 | |

TABLE 8A

FIG. 3 Single-Unit Gas Separator Stream Compositions

| Mole Frac | 201 | 202 | 203 | 204 | 206 | 208 | 209 | 210 | 211 |
|---|---|---|---|---|---|---|---|---|---|
| Nitrogen | 0.0162* | 0.0162 | 0.0162 | 0.0162 | 0.0000 | 0.0179 | 0.0179 | 0.0054 | 0.0054 |
| $CO_2$ | 0.0041* | 0.0041 | 0.0041 | 0.0041 | 0.0038 | 0.0046 | 0.0046 | 0.0074 | 0.0074 |
| Methane | 0.7465* | 0.7465 | 0.7465 | 0.7465 | 0.0244 | 0.8772 | 0.8772 | 0.6618 | 0.6618 |
| Ethane | 0.0822* | 0.0822 | 0.0822 | 0.0822 | 0.2036 | 0.0743 | 0.0743 | 0.1990 | 0.1990 |
| Propane | 0.0608* | 0.0608 | 0.0608 | 0.0608 | 0.2850 | 0.0238 | 0.0238 | 0.1133 | 0.1133 |
| i-Butane | 0.0187 | 0.0187 | 0.0187 | 0.0187 | 0.0994 | 0.0013 | 0.0013 | 0.0081 | 0.0081 |
| n-Butane | 0.0281 | 0.0281 | 0.0281 | 0.0281 | 0.1505 | 0.0008 | 0.0008 | 0.0047 | 0.0047 |
| i-Pentane | 0.0150 | 0.0150 | 0.0150 | 0.0150 | 0.0806 | 0.0000 | 0.0000 | 0.0002 | 0.0002 |
| n-Pentane | 0.0169 | 0.0169 | 0.0169 | 0.0169 | 0.0909 | 0.0000 | 0.0000 | 0.0001 | 0.0001 |
| Hexane | 0.0060 | 0.0060 | 0.0060 | 0.0060 | 0.0323 | 0.0000 | 0.0000 | 0.0000 | 0.0000 |
| Heptane | 0.0040 | 0.0040 | 0.0040 | 0.0040 | 0.0215 | 0.0000 | 0.0000 | 0.0000 | 0.0000 |
| Octane | 0.0015 | 0.0015 | 0.0015 | 0.0015 | 0.0081 | 0.0000 | 0.0000 | 0.0000 | 0.0000 |

TABLE 8A-continued

| FIG. 3 Single-Unit Gas Separator Stream Compositions | | | | | | | | | |
|---|---|---|---|---|---|---|---|---|---|
| Mole Frac | 201 | 202 | 203 | 204 | 206 | 208 | 209 | 210 | 211 |
| Water | 0.0000 | 0.0000 | 0.0000 | 0.0000 | 0.0000 | 0.0000 | 0.0000 | 0.0000 | 0.0000 |
| $H_2S$ | 0.0000 | 0.0000 | 0.0000 | 0.0000 | 0.0000 | 0.0000 | 0.0000 | 0.0000 | 0.0000 |

TABLE 8B

| FIG. 3 Single-Unit Gas Separator Stream Compositions | | | | | | | | |
|---|---|---|---|---|---|---|---|---|
| Mole Frac | 212 | 213 | 214 | 215 | 216 | 217 | 218 | 219 |
| Nitrogen | 0.0199 | 0.0199 | 0.0199 | 0.0199 | 0.0199 | 0.0199 | 0.0199 | 0.0199 |
| $CO_2$ | 0.0041 | 0.0041 | 0.0041 | 0.0041 | 0.0041 | 0.0041 | 0.0041 | 0.0041 |
| Methane | 0.9117 | 0.9117 | 0.9117 | 0.9117 | 0.9117 | 0.9117 | 0.9117 | 0.9117 |
| Ethane | 0.0544 | 0.0544 | 0.0544 | 0.0544 | 0.0544 | 0.0544 | 0.0544 | 0.0544 |
| Propane | 0.0095 | 0.0095 | 0.0095 | 0.0095 | 0.0095 | 0.0095 | 0.0095 | 0.0095 |
| i-Butane | 0.0003 | 0.0003 | 0.0003 | 0.0003 | 0.0003 | 0.0003 | 0.0003 | 0.0003 |
| n-Butane | 0.0001 | 0.0001 | 0.0001 | 0.0001 | 0.0001 | 0.0001 | 0.0001 | 0.0001 |
| i-Pentane | 0.0000 | 0.0000 | 0.0000 | 0.0000 | 0.0000 | 0.0000 | 0.0000 | 0.0000 |
| n-Pentane | 0.0000 | 0.0000 | 0.0000 | 0.0000 | 0.0000 | 0.0000 | 0.0000 | 0.0000 |
| Hexane | 0.0000 | 0.0000 | 0.0000 | 0.0000 | 0.0000 | 0.0000 | 0.0000 | 0.0000 |
| Heptane | 0.0000 | 0.0000 | 0.0000 | 0.0000 | 0.0000 | 0.0000 | 0.0000 | 0.0000 |
| Octane | 0.0000 | 0.0000 | 0.0000 | 0.0000 | 0.0000 | 0.0000 | 0.0000 | 0.0000 |
| Water | 0.0000 | 0.0000 | 0.0000 | 0.0000 | 0.0000 | 0.0000 | 0.0000 | 0.0000 |
| $H_2S$ | 0.0000 | 0.0000 | 0.0000 | 0.0000 | 0.0000 | 0.0000 | 0.0000 | 0.0000 |

TABLE 9

| FIG. 3 Single-Unit Gas Separator Energy Streams | | | | | |
|---|---|---|---|---|---|
| Energy Flow | 301 | 302 | 304 | 305 | 306 |
| Btu/hr | 3,897,000 | 5,690,000 | 1,977,000 | 2,830,000 | 8,645 |

A second process simulation was performed using the single-unit gas separation process 150 shown in FIG. 3. The simulation was performed using the Aspen HYSYS Version 7.2 software package. This second simulation was run with a different feed composition. The material streams, their compositions, and the associated energy streams produced by the simulation are provided in Tables 10-12 below. The specified values are indicated by an asterisk (*). The physical properties are provided in degrees F., psig, MMSCFD, lb/hr, barrel/day, Btu/ft$^3$, and Btu/hr.

TABLE 10A

| FIG. 3 Single-Unit Gas Separator Stream Properties | | | | | | |
|---|---|---|---|---|---|---|
| Property | 201 | 202 | 203 | 204 | 206 | 208 |
| Vapor Fraction | 1 | 0.9608 | 0.7875 | 0.7796 | 0 | 1 |
| Temperature (F.) | 100* | 40.14 | −15 | −17 | 227.7 | −15.22 |
| Pressure (psig) | 800* | 795 | 790 | 785 | 710 | 700 |
| Molar Flow (MMSCFD) | 25* | 25 | 25 | 25 | 2.315 | 25.56 |
| Mass Flow (lb/hr) | 59670 | 59670 | 59670 | 59670 | 11930 | 56010 |
| Liquid Vol. Flow (barrel/day) | 11600 | 11600 | 11600 | 11600 | 1608 | 11510 |
| Heat Flow (Btu/hr) | −9.54E+07 | −9.81E+07 | −1.02E+08 | −1.02E+08 | −1.23E+07 | −9.85E+07 |

TABLE 10B

| FIG. 3 Single-Unit Gas Separator Stream Properties | | | | | | |
|---|---|---|---|---|---|---|
| Property | 209 | 210 | 211 | 212 | 213 | 214 |
| Vapor Fraction | 0.8884 | 0 | 0 | 1 | 0.9591 | 1 |
| Temperature (F.) | −34.39 | −34.49 | −32.7 | −34.49 | −71.3 | −30 |
| Pressure (psig) | 695 | 695 | 795 | 695 | 300 | 295 |
| Molar Flow (MMSCFD) | 25.56 | 2.878 | 2.878 | 22.7 | 22.7 | 22.7 |
| Mass Flow (lb/hr) | 56010 | 8273 | 8273 | 47760 | 47760 | 47760 |
| Liquid Vol. Flow (barrel/day) | 11510 | 1523 | 1523 | 9997 | 9997 | 9997 |
| Heat Flow (Btu/hr) | −1.00E+08 | −1.31E+07 | −1.31E+07 | −8.70E+07 | −8.70E+07 | −8.55E+07 |

TABLE 10C

FIG. 3 Single-Unit Gas Separator Stream Properties

| Property | 215 | 216 | 217 | 218 | 219 |
|---|---|---|---|---|---|
| Vapor Fraction | 1 | 1 | 1 | 1 | 1 |
| Temperature (F.) | −25.81 | 80 | 148.6 | 120 | 167.9 |
| Pressure (psig) | 290 | 287 | 450 | 445 | 600 |
| Molar Flow (MMSCFD) | 22.7 | 22.7 | 22.7 | 22.7 | 22.7 |
| Mass Flow (lb/hr) | 47760 | 47760 | 47760 | 47760 | 47760 |
| Liquid Vol. Flow (barrel/day) | 9997 | 9997 | 9997 | 9997 | 9997 |
| Heat Flow (Btu/hr) | −8.53E+07 | −8.27E+07 | −8.12E+07 | −8.19E+07 | −8.09E+07 |

TABLE 10D

FIG. 3 Single-Unit Gas Separator Stream Properties

| | 201 | 206 | 219 |
|---|---|---|---|
| Energy Content (Btu/ft$^3$) | 1299.9 | | 1132.9 |
| Vapor Pressure (psig) | | 200 | |

TABLE 11A

FIG. 3 Single-Unit Gas Separator Stream Compositions

| Mole Frac | 201 | 202 | 203 | 204 | 206 | 208 | 209 | 210 | 211 |
|---|---|---|---|---|---|---|---|---|---|
| Nitrogen | 0.0158* | 0.0158 | 0.0158 | 0.0158 | 0.0000 | 0.0159 | 0.0159 | 0.0038 | 0.0038 |
| $CO_2$ | 0.004* | 0.0040 | 0.0040 | 0.0040 | 0.0004 | 0.0045 | 0.0045 | 0.0053 | 0.0053 |
| Methane | 0.7266* | 0.7266 | 0.7266 | 0.7266 | 0.0042 | 0.7601 | 0.7601 | 0.4429 | 0.4429 |
| Ethane | 0.1616* | 0.1616 | 0.1616 | 0.1616 | 0.2434 | 0.1793 | 0.1793 | 0.3851 | 0.3851 |
| Propane | 0.0592* | 0.0592 | 0.0592 | 0.0592 | 0.4579 | 0.0323 | 0.0323 | 0.1410 | 0.1410 |
| i-Butane | 0.0059* | 0.0059 | 0.0059 | 0.0059 | 0.0607 | 0.0007 | 0.0007 | 0.0043 | 0.0043 |
| n-Butane | 0.0111* | 0.0111 | 0.0111 | 0.0111 | 0.1183 | 0.0005 | 0.0005 | 0.0034 | 0.0034 |
| i-Pentane | 0.0025* | 0.0025 | 0.0025 | 0.0025 | 0.0270 | 0.0000 | 0.0000 | 0.0001 | 0.0001 |
| n-Pentane | 0.0034* | 0.0034 | 0.0034 | 0.0034 | 0.0367 | 0.0000 | 0.0000 | 0.0000 | 0.0000 |
| Hexane | 0.0018* | 0.0018 | 0.0018 | 0.0018 | 0.0194 | 0.0000 | 0.0000 | 0.0000 | 0.0000 |
| Heptane | 0.0001* | 0.0010 | 0.0010 | 0.0010 | 0.0108 | 0.0000 | 0.0000 | 0.0000 | 0.0000 |
| Octane | 0.0001* | 0.0010 | 0.0010 | 0.0010 | 0.0108 | 0.0000 | 0.0000 | 0.0000 | 0.0000 |
| Water | 0* | 0.0000 | 0.0000 | 0.0000 | 0.0000 | 0.0000 | 0.0000 | 0.0000 | 0.0000 |
| $H_2S$ | 0.0062* | 0.0062 | 0.0062 | 0.0062 | 0.0103 | 0.0067 | 0.0067 | 0.0142 | 0.0142 |

TABLE 11B

FIG. 3 Single-Unit Gas Separator Stream Compositions

| Mole Frac | 212 | 213 | 214 | 215 | 216 | 217 | 218 | 219 |
|---|---|---|---|---|---|---|---|---|
| Nitrogen | 0.0174 | 0.0174 | 0.0174 | 0.0174 | 0.0174 | 0.0174 | 0.0174 | 0.0174 |
| $CO_2$ | 0.0044 | 0.0044 | 0.0044 | 0.0044 | 0.0044 | 0.0044 | 0.0044 | 0.0044 |
| Methane | 0.8002 | 0.8002 | 0.8002 | 0.8002 | 0.8002 | 0.8002 | 0.8002 | 0.8002 |
| Ethane | 0.1534 | 0.1534 | 0.1534 | 0.1534 | 0.1534 | 0.1534 | 0.1534 | 0.1534 |
| Propane | 0.0185 | 0.0185 | 0.0185 | 0.0185 | 0.0185 | 0.0185 | 0.0185 | 0.0185 |
| i-Butane | 0.0003 | 0.0003 | 0.0003 | 0.0003 | 0.0003 | 0.0003 | 0.0003 | 0.0003 |
| n-Butane | 0.0002 | 0.0002 | 0.0002 | 0.0002 | 0.0002 | 0.0002 | 0.0002 | 0.0002 |
| i-Pentane | 0.0000 | 0.0000 | 0.0000 | 0.0000 | 0.0000 | 0.0000 | 0.0000 | 0.0000 |
| n-Pentane | 0.0000 | 0.0000 | 0.0000 | 0.0000 | 0.0000 | 0.0000 | 0.0000 | 0.0000 |
| Hexane | 0.0000 | 0.0000 | 0.0000 | 0.0000 | 0.0000 | 0.0000 | 0.0000 | 0.0000 |
| Heptane | 0.0000 | 0.0000 | 0.0000 | 0.0000 | 0.0000 | 0.0000 | 0.0000 | 0.0000 |
| Octane | 0.0000 | 0.0000 | 0.0000 | 0.0000 | 0.0000 | 0.0000 | 0.0000 | 0.0000 |
| Water | 0.0000 | 0.0000 | 0.0000 | 0.0000 | 0.0000 | 0.0000 | 0.0000 | 0.0000 |
| $H_2S$ | 0.0058 | 0.0058 | 0.0058 | 0.0058 | 0.0058 | 0.0058 | 0.0058 | 0.0058 |

TABLE 12

FIG. 3 Single-Unit Gas Separator Energy Streams

| Energy Flow | 301 | 302 | 304 | 305 | 306 |
|---|---|---|---|---|---|
| Btu/hr | 3,470,000 | 3,949,000 | 1,063,000 | 1,511,000 | 8,293 |

In another example, a process simulation was performed using the single-unit gas separation process 160 shown in FIG. 4. The simulation was performed using the Aspen HYSYS Version 7.2 software package. The material streams, their compositions, and the associated energy streams produced by the simulation are provided in Tables 13-15 below. The specified values are indicated by an asterisk (*). The physical properties are provided in degrees F., psig, MMSCFD, Btu/ft$^3$, and Btu/hr.

TABLE 13A

FIG. 4 Single-Unit Gas Separator Stream Properties

| Property | 201 | 202 | 203 | 206 | 208 |
|---|---|---|---|---|---|
| Vapor Fraction | 0.9352 | 0.8511 | 0.7101 | 0.0008 | 1 |
| Temperature (F.) | 100* | 46.69 | −20 | 249.9 | −53.62 |
| Pressure (psig) | 800* | 795 | 790 | 705 | 700 |
| Molar Flow (MMSCFD) | 25* | 25 | 25 | 4.803 | 25.06 |
| Mass Flow (lb/hr) | 65690 | 65690 | 65690 | 27330 | 49570 |
| Liquid Vol. Flow (barrel/day) | 11860 | 11860 | 11860 | 3508 | 10610 |
| Heat Flow (Btu/hr) | −1.01E+08 | 1.05E+08 | −1.08E+08 | −2.76E+07 | −9.61E+07 |

TABLE 13B

FIG. 4 Single-Unit Gas Separator Stream Properties

| Property | 209 | 210 | 211 | 212 | 213 |
|---|---|---|---|---|---|
| Vapor Fraction | 0.8048 | 0 | 0 | 1 | 0.8842 |
| Temperature (F.) | −85.12 | −85.02 | −82.99 | −85.02 | −131.8 |
| Pressure (psig) | 695 | 695 | 795 | 695 | 325 |
| Molar Flow (MMSCFD) | 25.06 | 4.859 | 4.859 | 20.08 | 20.08 |
| Mass Flow (lb/hr) | 49570 | 11220 | 11220 | 38150 | 38150 |
| Liquid Vol. Flow (barrel/day) | 10610 | 2253 | 2253 | 8305 | 8305 |
| Heat Flow (Btu/hr) | −9.85E+07 | −2.12E+07 | −2.12E+07 | −7.68E+07 | −7.73E+07 |

TABLE 13C

FIG. 4 Single-Unit Gas Separator Stream Properties

| Property | 214 | 216 | 217 | 219 |
|---|---|---|---|---|
| Vapor Fraction | 1 | 1 | 1 | 1 |
| Temperature (F.) | −65 | 80 | 107.7 | 236.8 |
| Pressure (psig) | 320 | 317 | 377.4 | 800 |
| Molar Flow (MMSCFD) | 20.08 | 20.08 | 20.08 | 20.08 |
| Mass Flow (lb/hr) | 38150 | 38150 | 38150 | 38150 |
| Liquid Vol. Flow (barrel/day) | 8305 | 8305 | 8305 | 8305 |

TABLE 13C-continued

FIG. 4 Single-Unit Gas Separator Stream Properties

| Property | 214 | 216 | 217 | 219 |
|---|---|---|---|---|
| Heat Flow (Btu/hr) | −7.49E+07 | −7.19E+07 | −7.14E+07 | −6.89E+07 |

TABLE 13D

FIG. 4 Single-Unit Gas Separator Stream Properties

| | 201 | 206 | 219 |
|---|---|---|---|
| Energy Content (Btu/ft$^3$) | 1395.72 | | 1034.03 |
| Vapor Pressure (psig) | | 250 | |

TABLE 14A

FIG. 4 Single-Unit Gas Separator Stream Compositions

| Mole Frac | 201 | 202 | 203 | 206 | 208 | 209 | 210 |
|---|---|---|---|---|---|---|---|
| Nitrogen | 0.0162* | 0.0162 | 0.0162 | 0.0000 | 0.0174 | 0.0174 | 0.0066 |
| $CO_2$ | 0.0041* | 0.0041 | 0.0041 | 0.0035 | 0.0049 | 0.0049 | 0.0078 |
| Methane | 0.7465* | 0.7465 | 0.7465 | 0.0244 | 0.8815 | 0.8815 | 0.7287 |
| Ethane | 0.0822* | 0.0822 | 0.0822 | 0.2120 | 0.0773 | 0.0773 | 0.1854 |
| Propane | 0.0608* | 0.0608 | 0.0608 | 0.2910 | 0.0177 | 0.0177 | 0.0663 |
| i-Butane | 0.0187 | 0.0187 | 0.0187 | 0.0970 | 0.0007 | 0.0007 | 0.0033 |
| n-Butane | 0.0281 | 0.0281 | 0.0281 | 0.1462 | 0.0004 | 0.0004 | 0.0018 |
| i-Pentane | 0.0150 | 0.0150 | 0.0150 | 0.0781 | 0.0000 | 0.0000 | 0.0001 |
| n-Pentane | 0.0169 | 0.0169 | 0.0169 | 0.0880 | 0.0000 | 0.0000 | 0.0000 |
| Hexane | 0.0050 | 0.0050 | 0.0050 | 0.0260 | 0.0000 | 0.0000 | 0.0000 |
| Heptane | 0.0021 | 0.0021 | 0.0021 | 0.0109 | 0.0000 | 0.0000 | 0.0000 |
| Octane | 0.0044 | 0.0044 | 0.0044 | 0.0229 | 0.0000 | 0.0000 | 0.0000 |
| Water | 0.0000 | 0.0000 | 0.0000 | 0.0000 | 0.0000 | 0.0000 | 0.0000 |
| $H_2S$ | 0.0000 | 0.0000 | 0.0000 | 0.0000 | 0.0000 | 0.0000 | 0.0000 |

TABLE 14B

FIG. 4 Single-Unit Gas Separator Stream Compositions

| Mole Frac | 211 | 212 | 213 | 214 | 216 | 217 | 219 |
|---|---|---|---|---|---|---|---|
| Nitrogen | 0.0066 | 0.0201 | 0.0201 | 0.0201 | 0.0201 | 0.0201 | 0.0201 |
| $CO_2$ | 0.0078 | 0.0042 | 0.0042 | 0.0042 | 0.0042 | 0.0042 | 0.0042 |
| Methane | 0.7287 | 0.9182 | 0.9182 | 0.9182 | 0.9182 | 0.9182 | 0.9182 |
| Ethane | 0.1854 | 0.0511 | 0.0511 | 0.0511 | 0.0511 | 0.0511 | 0.0511 |
| Propane | 0.0663 | 0.0062 | 0.0062 | 0.0062 | 0.0062 | 0.0062 | 0.0062 |
| i-Butane | 0.0033 | 0.0001 | 0.0001 | 0.0001 | 0.0001 | 0.0001 | 0.0001 |
| n-Butane | 0.0018 | 0.0001 | 0.0001 | 0.0001 | 0.0001 | 0.0001 | 0.0001 |
| i-Pentane | 0.0001 | 0.0000 | 0.0000 | 0.0000 | 0.0000 | 0.0000 | 0.0000 |
| n-Pentane | 0.0000 | 0.0000 | 0.0000 | 0.0000 | 0.0000 | 0.0000 | 0.0000 |
| Hexane | 0.0000 | 0.0000 | 0.0000 | 0.0000 | 0.0000 | 0.0000 | 0.0000 |
| Heptane | 0.0000 | 0.0000 | 0.0000 | 0.0000 | 0.0000 | 0.0000 | 0.0000 |
| Octane | 0.0000 | 0.0000 | 0.0000 | 0.0000 | 0.0000 | 0.0000 | 0.0000 |
| Water | 0.0000 | 0.0000 | 0.0000 | 0.0000 | 0.0000 | 0.0000 | 0.0000 |
| $H_2S$ | 0.0000 | 0.0000 | 0.0000 | 0.0000 | 0.0000 | 0.0000 | 0.0000 |

TABLE 15

FIG. 4 Single-Unit Gas Separator Energy Streams

| Energy Flow | 301 | 302 | 303 | 304 | 306 |
|---|---|---|---|---|---|
| Btu/hr | 3,881,000 | 5,844,000 | 509,500 | 2,500,000 | 13,030 |

A second process simulation was performed using the single-unit gas separation process 160 shown in FIG. 4. The simulation was performed using the Aspen HYSYS Version 7.2 software package. This second simulation was run with a different feed composition. The material streams, their compositions, and the associated energy streams produced by the simulation are provided in Tables 16-18 below. The specified values are indicated by an asterisk (*). The physical properties are provided in degrees F., psig, MMSCFD, lb/hr, barrel/day, Btu/ft$^3$, and Btu/hr.

TABLE 16A

FIG. 4 Single-Unit Gas Separator Stream Properties

| Property | 201 | 202 | 203 | 206 | 208 |
|---|---|---|---|---|---|
| Vapor Fraction | 0.9458 | 0.8955 | 0.8594 | 0 | 1 |
| Temperature (F.) | 100* | 19.52 | −20 | 250.2 | −83.96 |
| Pressure (psig) | 600* | 595 | 590 | 555 | 550 |
| Molar Flow (MMSCFD) | 10* | 10 | 10 | 1.228 | 12.1 |
| Mass Flow (lb/hr) | 25190 | 25190 | 25190 | 8408 | 24190 |
| Liquid Vol. Flow (barrel/day) | 4570 | 4570 | 4570 | 988.6 | 5065 |
| Heat Flow (Btu/hr) | −4.20E+07 | −4.35E+07 | −4.42E+07 | −8.37E+06 | −5.06E+07 |

TABLE 16B

FIG. 4 Single-Unit Gas Separator Stream Properties

| Property | 209 | 210 | 211 | 212 | 213 |
|---|---|---|---|---|---|
| Vapor Fraction | 0.7243 | 0 | 0 | 1 | 0.8796 |
| Temperature (F.) | −105.9 | −105.9 | 103.9 | −105.9 | −175.2 |
| Pressure (psig) | 545 | 545 | 645 | 545 | 130 |
| Molar Flow (MMSCFD) | 12.1 | 3.326 | 3.326 | 8.774 | 8.774 |
| Mass Flow (lb/hr) | 24190 | 7406 | 7406 | 16790 | 16790 |
| Liquid Vol. Flow (barrel/day) | 5065 | 1483 | 1483 | 3582 | 3582 |
| Heat Flow (Btu/hr) | −5.18E+07 | −1.63E+07 | −1.63E+07 | −3.55E+07 | −3.59E+07 |

TABLE 16C

FIG. 4 Single-Unit Gas Separator Stream Properties

| Property | 214 | 216 | 217 | 219 |
|---|---|---|---|---|
| Vapor Fraction | 1 | 1 | 1 | 1 |
| Temperature (F.) | −90 | 80 | 129.4 | 353.1 |
| Pressure (psig) | 125 | 122 | 168.8 | 600 |
| Molar Flow (MMSCFD) | 8.774 | 8.774 | 8.774 | 8.774 |
| Mass Flow (lb/hr) | 16790 | 16790 | 16790 | 16790 |
| Liquid Vol. Flow (barrel/day) | 3582 | 3582 | 3582 | 3582 |

TABLE 16C-continued

FIG. 4 Single-Unit Gas Separator Stream Properties

| Property | 214 | 216 | 217 | 219 |
|---|---|---|---|---|
| Heat Flow (Btu/hr) | −3.47E+07 | −3.32E+07 | −3.28E+07 | −3.08E+07 |

TABLE 16D

FIG. 4 Single-Unit Gas Separator Stream Properties

| | 201 | 206 | 219 |
|---|---|---|---|
| Energy Content (Btu/ft$^3$) | 1295 | | 994 |
| Vapor Pressure (psig) | | 200 | |

TABLE 17A

FIG. 4 Single-Unit Gas Separator Stream Compositions

| Mole Frac | 201 | 202 | 203 | 206 | 208 | 209 | 210 |
|---|---|---|---|---|---|---|---|
| Nitrogen | 0.0202* | 0.0202 | 0.0202 | 0.0000 | 0.0186 | 0.0186 | 0.0069 |
| $CO_2$ | 0.0202* | 0.0202 | 0.0202 | 0.0177 | 0.0289 | 0.0289 | 0.0509 |
| Methane | 0.808* | 0.8080 | 0.8080 | 0.0156 | 0.8733 | 0.8733 | 0.7529 |
| Ethane | 0.0505* | 0.0505 | 0.0505 | 0.1468 | 0.0774 | 0.0774 | 0.1838 |
| Propane | 0.0303* | 0.0303 | 0.0303 | 0.2437 | 0.0016 | 0.0016 | 0.0050 |
| i-Butane | 0.0101* | 0.0101 | 0.0101 | 0.0823 | 0.0000 | 0.0000 | 0.0000 |
| n-Butane | 0.0101* | 0.0101 | 0.0101 | 0.0823 | 0.0000 | 0.0000 | 0.0000 |
| i-Pentane | 0.0101* | 0.0101 | 0.0101 | 0.0823 | 0.0000 | 0.0000 | 0.0000 |
| n-Pentane | 0.0101* | 0.0101 | 0.0101 | 0.0823 | 0.0000 | 0.0000 | 0.0000 |
| Hexane | 0.0101* | 0.0101 | 0.0101 | 0.0823 | 0.0000 | 0.0000 | 0.0000 |
| Heptane | 0.0101* | 0.0101 | 0.0101 | 0.0823 | 0.0000 | 0.0000 | 0.0000 |
| Octane | 0.0101* | 0.0101 | 0.0101 | 0.0823 | 0.0000 | 0.0000 | 0.0000 |
| Water | 0* | 0.0000 | 0.0000 | 0.0000 | 0.0000 | 0.0000 | 0.0000 |
| $H_2S$ | 0.0001* | 0.0001 | 0.0001 | 0.0004 | 0.0002 | 0.0002 | 0.0004 |

TABLE 17B

FIG. 4 Single-Unit Gas Separator Stream Compositions

| Mole Frac | 211 | 212 | 213 | 214 | 216 | 217 | 219 |
|---|---|---|---|---|---|---|---|
| Nitrogen | 0.0069 | 0.0230 | 0.0230 | 0.0230 | 0.0230 | 0.0230 | 0.0230 |
| $CO_2$ | 0.0509 | 0.0206 | 0.0206 | 0.0206 | 0.0206 | 0.0206 | 0.0206 |
| Methane | 0.7529 | 0.9190 | 0.9190 | 0.9190 | 0.9190 | 0.9190 | 0.9190 |
| Ethane | 0.1838 | 0.0371 | 0.0371 | 0.0371 | 0.0371 | 0.0371 | 0.0371 |
| Propane | 0.0050 | 0.0003 | 0.0003 | 0.0003 | 0.0003 | 0.0003 | 0.0003 |
| i-Butane | 0.0000 | 0.0000 | 0.0000 | 0.0000 | 0.0000 | 0.0000 | 0.0000 |
| n-Butane | 0.0000 | 0.0000 | 0.0000 | 0.0000 | 0.0000 | 0.0000 | 0.0000 |
| i-Pentane | 0.0000 | 0.0000 | 0.0000 | 0.0000 | 0.0000 | 0.0000 | 0.0000 |
| n-Pentane | 0.0000 | 0.0000 | 0.0000 | 0.0000 | 0.0000 | 0.0000 | 0.0000 |
| Hexane | 0.0000 | 0.0000 | 0.0000 | 0.0000 | 0.0000 | 0.0000 | 0.0000 |
| Heptane | 0.0000 | 0.0000 | 0.0000 | 0.0000 | 0.0000 | 0.0000 | 0.0000 |
| Octane | 0.0000 | 0.0000 | 0.0000 | 0.0000 | 0.0000 | 0.0000 | 0.0000 |
| Water | 0.0000 | 0.0000 | 0.0000 | 0.0000 | 0.0000 | 0.0000 | 0.0000 |
| $H_2S$ | 0.0004 | 0.0001 | 0.0001 | 0.0001 | 0.0001 | 0.0001 | 0.0001 |

TABLE 18

| FIG. 4 Single-Unit Gas Separator Stream Properties | | | | | |
|---|---|---|---|---|---|
| Energy Flow | 301 | 302 | 303 | 304 | 306 |
| Btu/hr | 723,800 | 1,546,000 | 409,900 | 2,035,000 | 8,157 |

In another example, a process simulation was performed using the single-unit gas separation process 170 shown in FIG. 5. The simulation was performed using the Aspen HYSYS Version 7.2 software package. The material streams, their compositions, and the associated energy streams produced by the simulation are provided in Tables 19-21 below. The specified values are indicated by an asterisk (*). The physical properties are provided in degrees Fahrenheit (F), pounds per square inch gauge (psig), million standard cubic feet per day (MMSCFD), British thermal units per standard cubic feet (Btu/ft$^3$), and British thermal units per hour (Btu/hr).

TABLE 19A

| FIG. 5 Single-Unit Gas Separator Stream Properties | | | | | | |
|---|---|---|---|---|---|---|
| Property | 201 | 202 | 203 | 204 | 206 | 208 |
| Vapor Fraction | 0.9335 | 0.8517 | 0.7158 | 0.7087 | 0.0002 | 1 |
| Temperature (F.) | 100* | 48.9 | −15 | −18 | 253.6 | −55.46 |
| Pressure (psig) | 800* | 795 | 790 | 785 | 710 | 700 |
| Molar Flow (MMSCFD) | 25* | 25 | 25 | 25 | 4.775 | 25.62 |
| Mass Flow (lb/hr) | 65680 | 65680 | 65680 | 65680 | 27250 | 50700 |
| Liquid Vol. Flow (barrel/day) | 11860 | 11860 | 11860 | 11860 | 3491 | 10860 |
| Heat Flow (Btu/hr) | −1.01E+08 | −1.04E+00 | −1.08E+08 | −1.08E+08 | −2.75E+07 | −9.83E+07 |

TABLE 19B

| FIG. 5 Single-Unit Gas Separator Stream Properties | | | | | | |
|---|---|---|---|---|---|---|
| Property | 209 | 210 | 211 | 212 | 213 | 214 |
| Vapor Fraction | 0.7893 | 0 | 0 | 1 | 0.8813 | 1 |
| Temperature (F.) | −85.38 | −85.39 | −83.26 | −85.39 | −132.1 | −65 |
| Pressure (psig) | 695 | 695 | 795 | 695 | 325 | 320 |
| Molar Flow (MMSCFD) | 25.62 | 5.399 | 5.399 | 20.23 | 20.23 | 20.23 |
| Mass Flow (lb/hr) | 50700 | 12280 | 12280 | 38440 | 38440 | 38440 |
| Liquid Vol. Flow (barrel/day) | 10860 | 2488 | 2488 | 8372 | 8372 | 8372 |
| Heat Flow (Btu/hr) | −1.01E+08 | −2.34E+07 | −2.34E+07 | −7.74E+07 | −7.79E+07 | 7.54E+07 |

TABLE 19C

| FIG. 5 Single-Unit Gas Separator Stream Properties | | | | | |
|---|---|---|---|---|---|
| Property | 215 | 216 | 217 | 218 | 219 |
| Vapor Fraction | 1 | 1 | 1 | 1 | 1 |
| Temperature (F.) | −58.02 | 80 | 107.5 | 120 | 256 |
| Pressure (psig) | 315 | 312 | 371.1 | 366.1 | 800 |
| Molar Flow (MMSCFD) | 20.23 | 20.23 | 20.23 | 20.23 | 20.23 |
| Mass Flow (lb/hr) | 38440 | 38440 | 38440 | 38440 | 38440 |
| Liquid Vol. Flow (barrel/day) | 8372 | 8372 | 8372 | 8372 | 8372 |
| Heat Flow (Btu/hr) | −7.53E+07 | −7.24E+07 | −7.19E+07 | −7.16E+07 | −6.89E+07 |

TABLE 19D

| FIG. 5 Single-Unit Gas Separator Stream Properties | | | |
|---|---|---|---|
| | 201 | 206 | 219 |
| Energy Content (Btu/ft$^3$) | 1395.72 | | 1034.54 |
| Vapor Pressure (psig) | | 250 | |

TABLE 20A

| FIG. 5 Single-Unit Gas Separator Stream Compositions | | | | | | | | | |
|---|---|---|---|---|---|---|---|---|---|
| Mole Frac | 201 | 202 | 203 | 204 | 206 | 208 | 209 | 210 | 211 |
| Nitrogen | 0.0162* | 0.0162 | 0.0162 | 0.0162 | 0.0000 | 0.0173 | 0.0173 | 0.0068 | 0.0068 |
| $CO_2$ | 0.0041* | 0.0041 | 0.0041 | 0.0041 | 0.0043 | 0.0048 | 0.0048 | 0.0074 | 0.0074 |
| Methane | 0.7465* | 0.7465 | 0.7465 | 0.7465 | 0.0225 | 0.8799 | 0.8799 | 0.7391 | 0.7391 |

TABLE 20A-continued

| FIG. 5 Single-Unit Gas Separator Stream Compositions | | | | | | | | | |
|---|---|---|---|---|---|---|---|---|---|
| Mole Frac | 201 | 202 | 203 | 204 | 206 | 208 | 209 | 210 | 211 |
| Ethane | 0.0822* | 0.0822 | 0.0822 | 0.0822 | 0.2085 | 0.0800 | 0.0800 | 0.1837 | 0.1837 |
| Propane | 0.0608* | 0.0608 | 0.0608 | 0.0608 | 0.2931 | 0.0176 | 0.0176 | 0.0610 | 0.0610 |
| i-Butane | 0.0187 | 0.0187 | 0.0187 | 0.0187 | 0.0978 | 0.0004 | 0.0004 | 0.0014 | 0.0014 |
| n-Butane | 0.0281 | 0.0281 | 0.0281 | 0.0281 | 0.1471 | 0.0001 | 0.0001 | 0.0006 | 0.0006 |
| i-Pentane | 0.0150 | 0.0150 | 0.0150 | 0.0150 | 0.0785 | 0.0000 | 0.0000 | 0.0000 | 0.0000 |
| n-Pentane | 0.0169 | 0.0169 | 0.0169 | 0.0169 | 0.0883 | 0.0000 | 0.0000 | 0.0000 | 0.0000 |
| Hexane | 0.0050 | 0.0050 | 0.0050 | 0.0050 | 0.0260 | 0.0000 | 0.0000 | 0.0000 | 0.0000 |
| Heptane | 0.0021 | 0.0021 | 0.0021 | 0.0021 | 0.0108 | 0.0000 | 0.0000 | 0.0000 | 0.0000 |
| Octane | 0.0044 | 0.0044 | 0.0044 | 0.0044 | 0.0231 | 0.0000 | 0.0000 | 0.0000 | 0.0000 |
| Water | 0.0000 | 0.0000 | 0.0000 | 0.0000 | 0.0000 | 0.0000 | 0.0000 | 0.0000 | 0.0000 |
| $H_2S$ | 0.0000 | 0.0000 | 0.0000 | 0.0000 | 0.0000 | 0.0000 | 0.0000 | 0.0000 | 0.0000 |

TABLE 20B

| FIG. 5 Single-Unit Gas Separator Stream Compositions | | | | | | | | |
|---|---|---|---|---|---|---|---|---|
| Mole Frac | 212 | 213 | 214 | 215 | 216 | 217 | 218 | 219 |
| Nitrogen | 0.0201 | 0.0201 | 0.0201 | 0.0201 | 0.0201 | 0.0201 | 0.0201 | 0.0201 |
| $CO_2$ | 0.0041 | 0.0041 | 0.0041 | 0.0041 | 0.0041 | 0.0041 | 0.0041 | 0.0041 |
| Methane | 0.9175 | 0.9175 | 0.9175 | 0.9175 | 0.9175 | 0.9175 | 0.9175 | 0.9175 |
| Ethane | 0.0524 | 0.0524 | 0.0524 | 0.0524 | 0.0524 | 0.0524 | 0.0524 | 0.0524 |
| Propane | 0.0059 | 0.0059 | 0.0059 | 0.0059 | 0.0059 | 0.0059 | 0.0059 | 0.0059 |
| i-Butane | 0.0001 | 0.0001 | 0.0001 | 0.0001 | 0.0001 | 0.0001 | 0.0001 | 0.0001 |
| n-Butane | 0.0000 | 0.0000 | 0.0000 | 0.0000 | 0.0000 | 0.0000 | 0.0000 | 0.0000 |
| i-Pentane | 0.0000 | 0.0000 | 0.0000 | 0.0000 | 0.0000 | 0.0000 | 0.0000 | 0.0000 |
| n-Pentane | 0.0000 | 0.0000 | 0.0000 | 0.0000 | 0.0000 | 0.0000 | 0.0000 | 0.0000 |
| Hexane | 0.0000 | 0.0000 | 0.0000 | 0.0000 | 0.0000 | 0.0000 | 0.0000 | 0.0000 |
| Heptane | 0.0000 | 0.0000 | 0.0000 | 0.0000 | 0.0000 | 0.0000 | 0.0000 | 0.0000 |
| Octane | 0.0000 | 0.0000 | 0.0000 | 0.0000 | 0.0000 | 0.0000 | 0.0000 | 0.0000 |
| Water | 0.0000 | 0.0000 | 0.0000 | 0.0000 | 0.0000 | 0.0000 | 0.0000 | 0.0000 |
| $H_2S$ | 0.0000 | 0.0000 | 0.0000 | 0.0000 | 0.0000 | 0.0000 | 0.0000 | 0.0000 |

TABLE 21

| FIG. 5 Single-Unit Gas Separator Energy Streams | | | | | |
|---|---|---|---|---|---|
| Energy Flow | 301 | 302 | 303 | 304 | 306 |
| Btu/hr | 3,694,000 | 5,772,000 | 510,100 | 2,695,000 | 14,600 |

A second process simulation was performed using the single-unit gas separation process 170 shown in FIG. 5. The simulation was performed using the Aspen HYSYS Version 7.2 software package. This second simulation was run with a different feed composition. The material streams, their compositions, and the associated energy streams produced by the simulation are provided in Tables 22-24 below. The specified values are indicated by an asterisk (*). The physical properties are provided in degrees F., psig, MMSCFD, lb/hr, barrel/day, Btu/ft$^3$, and Btu/hr.

TABLE 22A

| FIG. 5 Single-Unit Gas Separator Stream Properties | | | | | | |
|---|---|---|---|---|---|---|
| Property | 201 | 202 | 203 | 204 | 206 | 208 |
| Vapor Fraction | 1 | 0.9627 | 0.7875 | 0.7796 | 0.0002 | 1 |
| Temperature (F.) | 100* | 41.32 | −15 | −17 | 226.3 | 19.08 |
| Pressure (psig) | 800* | 795 | 790 | 785 | 710 | 700 |
| Molar Flow (MMSCFD) | 25* | 25 | 25 | 25 | 2.572 | 28.32 |
| Mass Flow (lb/hr) | 59670 | 59670 | 59670 | 59670 | 13130 | 62320 |
| Liquid Vol. Flow (barrel/day) | 11600 | 11600 | 11600 | 11600 | 1776 | 12860 |
| Heat Flow (Btu/hr) | −9.54E+07 | −9.80E+07 | −1.02E+08 | −1.02E+08 | −1.36E+07 | −1.09E+08 |

TABLE 22B

| FIG. 5 Single-Unit Gas Separator Stream Properties | | | | | | |
|---|---|---|---|---|---|---|
| Property | 209 | 210 | 211 | 212 | 213 | 214 |
| Vapor Fraction | 0.7925 | 0 | 0 | 1 | 0.898 | 1 |
| Temperature (F.) | −44.81 | −44.96 | −43.02 | −44.96 | −92.48 | −30 |
| Pressure (psig) | 695 | 695 | 795 | 695 | 300 | 295 |
| Molar Flow (MMSCFD) | 28.32 | 5.888 | 5.888 | 22.43 | 22.43 | 22.43 |

TABLE 22B-continued

| FIG. 5 Single-Unit Gas Separator Stream Properties | | | | | | |
|---|---|---|---|---|---|---|
| Property | 209 | 210 | 211 | 212 | 213 | 214 |
| Mass Flow (lb/hr) | 62320 | 15780 | 15780 | 46530 | 46530 | 46530 |
| Liquid Vol. Flow (barrel/day) | 12860 | 3035 | 3035 | 9823 | 9823 | 9823 |
| Heat Flow (Btu/hr) | −1.12E+08 | −2.61E+07 | 2.61E+07 | −8.60E+07 | −8.68E+07 | −8.41E+07 |

TABLE 22C

| FIG. 5 Single-Unit Gas Separator Stream Properties | | | | | |
|---|---|---|---|---|---|
| Property | 215 | 216 | 217 | 218 | 219 |
| Vapor Fraction | 1 | 1 | 1 | 1 | 1 |
| Temperature (F.) | −25.68 | 80 | 116.7 | 120 | 202.8 |
| Pressure (psig) | 290 | 287 | 365.4 | 360.4 | 600 |
| Molar Flow (MMSCFD) | 22.43 | 22.43 | 22.43 | 22.43 | 22.43 |
| Mass Flow (lb/hr) | 46530 | 46530 | 46530 | 46530 | 46530 |
| Liquid Vol. Flow (barrel/day) | 9823 | 9823 | 9823 | 9823 | 9823 |
| Heat Flow (Btu/hr) | −8.40E+07 | −8.14E+07 | −8.06E+07 | −8.05E+07 | −7.87E+07 |

TABLE 22D

| FIG. 5 Single-Unit Gas Separator Stream Properties | | | |
|---|---|---|---|
| | 201 | 206 | 219 |
| Energy Content (Btu/ft$^3$) | 1299.9 | | 1118 |
| Vapor Pressure (psig) | | 200 | |

TABLE 23A

| FIG. 5 Single-Unit Gas Separator Stream Compositions | | | | | | | | | |
|---|---|---|---|---|---|---|---|---|---|
| Mole Frac | 201 | 202 | 203 | 204 | 206 | 208 | 209 | 210 | 211 |
| Nitrogen | 0.0158* | 0.0158 | 0.0158 | 0.0158 | 0.0000 | 0.0148 | 0.0148 | 0.0043 | 0.0043 |
| $CO_2$ | 0.004* | 0.0040 | 0.0040 | 0.0040 | 0.0003 | 0.0047 | 0.0047 | 0.0059 | 0.0059 |
| Methane | 0.7266* | 0.7266 | 0.7266 | 0.7266 | 0.0046 | 0.7430 | 0.7430 | 0.4902 | 0.4902 |
| Ethane | 0.1616* | 0.1616 | 0.1616 | 0.1616 | 0.2329 | 0.2066 | 0.2066 | 0.4091 | 0.4091 |
| Propane | 0.0592* | 0.0592 | 0.0592 | 0.0592 | 0.4941 | 0.0228 | 0.0228 | 0.0744 | 0.0744 |
| i-Butane | 0.0059* | 0.0059 | 0.0059 | 0.0059 | 0.0565 | 0.0002 | 0.0002 | 0.0008 | 0.0008 |
| n-Butane | 0.0111* | 0.0111 | 0.0111 | 0.0111 | 0.1077 | 0.0001 | 0.0001 | 0.0005 | 0.0005 |
| i-Pentane | 0.0025* | 0.0025 | 0.0025 | 0.0025 | 0.0243 | 0.0000 | 0.0000 | 0.0000 | 0.0000 |
| n-Pentane | 0.0034* | 0.0034 | 0.0034 | 0.0034 | 0.0333 | 0.0000 | 0.0000 | 0.0000 | 0.0000 |
| Hexane | 0.0018* | 0.0018 | 0.0018 | 0.0018 | 0.0175 | 0.0000 | 0.0000 | 0.0000 | 0.0000 |
| Heptane | 0.001* | 0.0010 | 0.0010 | 0.0010 | 0.0097 | 0.0000 | 0.0000 | 0.0000 | 0.0000 |
| Octane | 0.001* | 0.0010 | 0.0010 | 0.0010 | 0.0097 | 0.0000 | 0.0000 | 0.0000 | 0.0000 |
| Water | 0* | 0.0000 | 0.0000 | 0.0000 | 0.0000 | 0.0000 | 0.0000 | 0.0000 | 0.0000 |
| $H_2S$ | 0.0062* | 0.0062 | 0.0062 | 0.0062 | 0.0097 | 0.0077 | 0.0077 | 0.0148 | 0.0148 |

TABLE 23B

| FIG. 5 Single-Unit Gas Separator Stream Compositions | | | | | | | | |
|---|---|---|---|---|---|---|---|---|
| Mole Frac | 212 | 213 | 214 | 215 | 216 | 217 | 218 | 219 |
| Nitrogen | 0.0176 | 0.0176 | 0.0176 | 0.0176 | 0.0176 | 0.0176 | 0.0176 | 0.0176 |
| $CO_2$ | 0.0044 | 0.0044 | 0.0044 | 0.0044 | 0.0044 | 0.0044 | 0.0044 | 0.0044 |
| Methane | 0.8099 | 0.8099 | 0.8099 | 0.8099 | 0.8099 | 0.8099 | 0.8099 | 0.8099 |
| Ethane | 0.1529 | 0.1529 | 0.1529 | 0.1529 | 0.1529 | 0.1529 | 0.1529 | 0.1529 |
| Propane | 0.0093 | 0.0093 | 0.0093 | 0.0093 | 0.0093 | 0.0093 | 0.0093 | 0.0093 |
| i-Butane | 0.0000 | 0.0000 | 0.0000 | 0.0000 | 0.0000 | 0.0000 | 0.0000 | 0.0000 |
| n-Butane | 0.0000 | 0.0000 | 0.0000 | 0.0000 | 0.0000 | 0.0000 | 0.0000 | 0.0000 |
| i-Pentane | 0.0000 | 0.0000 | 0.0000 | 0.0000 | 0.0000 | 0.0000 | 0.0000 | 0.0000 |
| n-Pentane | 0.0000 | 0.0000 | 0.0000 | 0.0000 | 0.0000 | 0.0000 | 0.0000 | 0.0000 |
| Hexane | 0.0000 | 0.0000 | 0.0000 | 0.0000 | 0.0000 | 0.0000 | 0.0000 | 0.0000 |
| Heptane | 0.0000 | 0.0000 | 0.0000 | 0.0000 | 0.0000 | 0.0000 | 0.0000 | 0.0000 |
| Octane | 0.0000 | 0.0000 | 0.0000 | 0.0000 | 0.0000 | 0.0000 | 0.0000 | 0.0000 |

TABLE 23B-continued

| FIG. 5 Single-Unit Gas Separator Stream Compositions | | | | | | | | |
|---|---|---|---|---|---|---|---|---|
| Mole Frac | 212 | 213 | 214 | 215 | 216 | 217 | 218 | 219 |
| Water | 0.0000 | 0.0000 | 0.0000 | 0.0000 | 0.0000 | 0.0000 | 0.0000 | 0.0000 |
| $H_2S$ | 0.0058 | 0.0058 | 0.0058 | 0.0058 | 0.0058 | 0.0058 | 0.0058 | 0.0058 |

TABLE 24

| FIG. 5 Single-Unit Gas Separator Energy Streams | | | | | |
|---|---|---|---|---|---|
| Energy Flow | 301 | 302 | 303 | 304 | 306 |
| Btu/hr | 3,533,000 | 4,773,000 | 784,200 | 1,854,000 | 16,660 |

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. All percentages used herein are weight percentages unless otherwise indicated. Moreover, any numerical range defined by two R numbers as defined in the above is also specifically disclosed. Use of broader terms such as comprises, includes, and having should be understood to provide support for narrower terms such as consisting of, consisting essentially of, and comprised substantially of. All documents described herein are incorporated herein by reference.

What is claimed is:

1. A process comprising:

receiving a hydrocarbon feed stream from a subterranean formation, the hydrocarbon feed stream having an energy content from about 900 British thermal units per cubic foot (Btu/ft$^3$) to about 1,800 Btu/ft$^3$, and the hydrocarbon feed stream comprising both a liquid phase and a gas phase such that a vapor fraction of the hydrocarbon feed stream is between zero and one;

separating the hydrocarbon feed stream into a top effluent stream and a liquefied petroleum gas-rich (LPG-rich) stream using process equipment comprising only one multi-stage separation column, the hydrocarbon feed stream comprising methane, ethane, propane, and nitrogen, the LPG-rich stream comprising less than or equal to about 3 molar percent of the methane in the hydrocarbon feed stream, the LPG-rich stream comprising from about 40 molar percent to about 50 molar percent of the ethane in the hydrocarbon feed stream, the LPG-rich stream comprising greater than or equal to about 85 molar percent of the propane in the hydrocarbon feed stream, the LPG-rich stream comprising none of the nitrogen in the hydrocarbon feed stream, the LPG-rich stream having a vapor pressure from about 200 pounds per a square inch gauge (psig) to about 300 psig, and the LPG-rich stream comprising only the liquid phase such that a vapor fraction of the LPG-rich stream is zero;

cooling the top effluent stream from the multi-stage separation column in a first heat exchanger using an expanded natural gas-rich stream to create a partially condensed stream comprising a vapor portion and a liquid portion, the expanded natural gas-rich stream comprising greater than or equal to about 97 molar percent of the methane in the hydrocarbon feed stream, the expanded natural gas-rich stream comprising from about 50 molar percent to about 60 molar percent of the ethane in the hydrocarbon feed stream, the expanded natural gas-rich stream comprising less than or equal to about 15 molar percent of the propane in the hydrocarbon feed stream, and the expanded natural gas-rich stream comprising all of the nitrogen in the hydrocarbon feed stream;

separating the vapor portion from the liquid portion in a single stage separator that receives the partially condensed stream from the first heat exchanger;

expanding the vapor portion from the single stage separator in an expander to produce the expanded natural gas-rich stream that is fed to the first heat exchanger, the expander reducing a pressure of the vapor portion, the expander being downstream from the multi-stage separation column, the expander comprising a Joules-Thompson (JT) expander, and the JT expander receiving the vapor portion from the single stage separator and feeding the expanded natural gas-rich stream to the first heat exchanger;

passing the liquid portion from the single stage separator to the one multi-stage separation column as reflux;

heating the expanded natural gas-rich stream in the first heat exchanger using the top effluent stream from the multi-stage separation column;

passing the expanded natural gas-rich stream from the first heat exchanger to a second heat exchanger;

cooling the hydrocarbon feed stream in the second heat exchanger using the expanded natural gas-rich stream;

feeding the hydrocarbon feed stream to the one multi-stage separation column, the one multi-stage separation column comprising three input streams, and the three input streams comprising the hydrocarbon feed stream, the reflux from the single stage separator, and a boil-up stream from a reboiler; and passing the expanded natural gas-rich stream from the second heat exchanger to a compressor that compresses the expanded natural gas-rich stream to form a compressed natural gas-rich stream, the compressed natural gas stream comprising only the gas phase such that a vapor fraction of the natural gas-rich stream is one.

2. The process of claim 1, wherein the expanded natural gas-rich stream has an energy content from about 950 Btu/ft$^3$ to about 1,150 Btu/ft$^3$.

3. The process of claim 1, wherein the natural gas-rich stream has an energy content of less than or equal to about 1,300 Btu/ft$^3$.

4. A process comprising:

receiving an unprocessed natural gas stream, the unprocessed natural gas stream comprising methane, ethane, propane, and nitrogen, the unprocessed natural gas stream being received from a subterranean formation, the unprocessed natural gas stream having an energy content from about 900 British thermal units per cubic foot (Btu/ft$^3$) to about 1,800 Btu/ft$^3$, and the unprocessed natural gas stream comprising both a liquid phase and a gas phase such that a vapor fraction of the unprocessed natural gas stream is between zero and one;

separating the unprocessed natural gas stream into a top effluent stream and a bottom liquefied petroleum gas-rich (LPG-rich) stream in a multi-stage separation column, the bottom LPG-rich stream comprising less than or equal to about 3 molar percent of the methane in the unprocessed natural gas stream, the bottom LPG-rich stream comprising from about 40 molar percent to about 50 molar percent of the ethane in the unprocessed natural gas stream, the bottom LPG-rich stream comprising greater than or equal to about 85 molar percent of the propane in the unprocessed natural gas stream, the bottom LPG-rich stream comprising none of the nitrogen in the unprocessed natural gas stream, the bottom LPG-rich stream having a vapor pressure from about 200 pounds per a square inch gauge (psig) to about 300 psig, and the bottom LPG-rich stream comprising only the liquid phase such that a vapor fraction of the bottom LPG-rich stream is zero;

cooling the top effluent stream in a first heat exchanger using an expanded natural gas-rich stream to create a partially condensed stream comprising a vapor portion and a liquid portion, the expanded natural gas-rich stream comprising greater than or equal to about 97 molar percent of the methane in the unprocessed natural gas stream, the expanded natural gas-rich stream comprising from about 50 molar percent to about 60 molar percent of the ethane in the unprocessed natural gas stream, the expanded natural gas-rich stream comprising less than or equal to about 15 molar percent of the propane in the unprocessed natural gas stream, and the expanded natural gas-rich stream comprising all of the nitrogen in the unprocessed natural gas stream;

separating the vapor portion from the liquid portion in a single stage separator that receives the partially condensed stream from the first heat exchanger;

expanding the vapor portion from the single stage separator in an expander to produce the expanded natural gas-rich stream that is fed to the first heat exchanger, the expander reducing a pressure of the vapor portion, the expander being downstream from the multi-stage separation column, the expander comprising a Joules-Thompson (JT) expander, and the JT expander receiving the vapor portion from the single stage separator and feeding the expanded natural gas-rich stream to the first heat exchanger;

passing the liquid portion from the single stage separator to the multi-stage separation column as reflux;

heating the expanded natural gas-rich stream in the first heat exchanger using the top effluent stream;

passing the expanded natural gas-rich stream from the first heat exchanger to a second heat exchanger;

cooling the unprocessed natural gas stream in the second heat exchanger using the expanded natural gas-rich stream;

passing the expanded natural gas-rich stream from the second heat exchanger to a compressor that compresses the expanded natural gas-rich stream to form a compressed natural gas-rich stream, the compressed natural gas-rich stream comprising only the gas phase such that a vapor fraction of the natural gas-rich stream is one; and feeding the unprocessed natural gas stream to the multi-stage separation column, the multi-stage separation column comprising three input streams, and the three input streams comprising the unprocessed natural gas stream, the reflux from the single stage separator, and a boil-up stream from a reboiler.

5. The process of claim 4, wherein the expanded natural gas-rich stream has an energy content from about 950 Btu/ft$^3$ to about 1,150 Btu/ft$^3$.

6. An apparatus comprising:

a multi-stage separation column configured to separate a hydrocarbon feed stream into a top effluent stream and a bottom liquefied petroleum gas-rich (LPG-rich) stream, the hydrocarbon feed stream being received from a subterranean formation, the hydrocarbon feed stream having an energy content from about 900 British thermal units per cubic foot (Btu/ft$^3$) to about 1,800 Btu/ft$^3$, the hydrocarbon feed stream comprising methane, ethane, propane, and nitrogen, the hydrocarbon feed stream comprising both a liquid phase and a gas phase such that a vapor fraction of the hydrocarbon feed stream is between zero and one, the bottom LPG-rich stream comprising less than or equal to about 3 molar percent of the methane in the hydrocarbon feed stream, the bottom LPG-rich stream comprising from about 40 molar percent to about 50 molar percent of the ethane in the hydrocarbon feed stream, the bottom LPG-rich stream comprising greater than or equal to about 85 molar percent of the propane in the hydrocarbon feed stream, the bottom LPG-rich stream comprising none of the nitrogen in the hydrocarbon feed stream, the bottom LPG-rich stream having a vapor pressure from about 200 pounds per a square inch gauge (psig) to about 300 psig, and the bottom LPG-rich stream comprising only the liquid phase such that a vapor fraction of the hydrocarbon feed stream is zero;

a first heat exchanger configured to cool the top effluent stream using an expanded natural gas-rich stream to create a partially condensed stream comprising a vapor portion and a liquid portion, the expanded natural gas-rich stream comprising greater than or equal to about 97 molar percent of the methane in the hydrocarbon feed stream, the expanded natural gas-rich stream comprising from about 50 molar percent to about 60 molar percent of the ethane in the hydrocarbon feed stream, the expanded natural gas-rich stream comprising less than or equal to about 15 molar percent of the propane in the hydrocarbon feed stream, and the expanded natural gas-rich stream comprising all of the nitrogen in the hydrocarbon feed stream;

a single stage separator configured to receive the partially condensed stream from the first heat exchanger and separate the vapor portion from the liquid portion;

an expander configured to receive the vapor portion from the single stage separator and expand the vapor portion into the expanded natural gas-rich stream that is fed to the first heat exchanger, the expander reducing a pressure of the vapor portion, the expander being downstream from the multi-stage separation column, the expander comprising a Joules-Thompson (JT) expander, and the JT expander receiving the vapor portion from the single stage separator and feeding the expanded natural gas-rich stream to the first heat exchanger;

a second heat exchanger configured to receive the expanded natural gas-rich stream from the first heat exchanger and to cool the hydrocarbon feed stream using the expanded natural gas-rich stream;

a pump configured to pass the liquid portion from the single stage separator to the multi-stage separation column as reflux, the multi-stage separation column being the only multi-stage separation column in the apparatus, the multi-stage separation column and the single stage separator being the only two separators in the apparatus, the multi-stage separation column comprising three input streams, and the three input streams comprising the hydrocarbon feed stream, the reflux from the single stage separator, and a boil-up stream from a reboiler; and a compressor that receives the expanded natural gas-rich stream from the second heat exchanger and that compresses the expanded natural gas-rich stream to form a compressed natural gas-rich stream, the compressor being coupled to the expansion turbine and using the energy generated from the expansion of the vapor portion to power the compressor, the compressed natural gas-rich stream comprising only the gas phase such that a vapor fraction of the compressed natural gas-rich stream is one, and the vapor portion having a substantially identical composition as the expanded natural gas-rich stream.

7. The apparatus of claim 6, wherein the third heat exchanger is configured to cool the hydrocarbon feed stream using mechanical refrigeration.

8. The apparatus of claim 7, further comprising a fourth heat exchanger configured to cool the hydrocarbon feed stream using the natural gas-rich stream, the hydrocarbon feed stream contacting the fourth heat exchanger, then the third heat exchanger, and then the second heat exchanger prior to entering the multi-stage separation column.

9. An apparatus comprising:

a multi-stage separation column configured to receive an unprocessed natural gas stream and separate the unprocessed natural gas stream into a top effluent stream and a bottom liquefied petroleum gas-rich (LPG-rich) stream, the unprocessed natural gas stream being received from a subterranean formation, the unprocessed natural gas stream having an energy content from about 900 British thermal units per cubic foot (Btu/ft$^3$) to about 1,800 Btu/ft$^3$, the unprocessed natural gas stream comprising both a liquid phase and a gas phase such that a vapor fraction of the unprocessed natural gas stream is between zero and one, the unprocessed natural gas stream comprises methane, ethane, propane, and nitrogen, the bottom LPG-rich stream comprising less than or equal to about 3 molar percent of the methane in the unprocessed natural gas stream, the bottom LPG-rich stream comprising from about 40 molar percent to about 50 molar percent of the ethane in the unprocessed natural gas stream, the bottom LPG-rich stream comprising greater than or equal to about 85 molar percent of the propane in the unprocessed natural gas stream, the bottom LPG-rich stream comprising none of the nitrogen in the unprocessed natural gas stream, the bottom LPG-rich stream having a vapor pressure from about 200 pounds per a square inch gauge (psig) to about 300 psig, and the bottom LPG-rich stream comprising only the liquid phase such that a vapor fraction of the bottom LPG-rich stream is zero;

a first heat exchanger configured to cool the top effluent stream using an expanded natural gas-rich stream to create a partially condensed stream comprising a vapor portion and a liquid portion, the expanded natural gas-rich stream comprising greater than or equal to about 97 molar percent of the methane in the unprocessed natural gas stream, the expanded natural gas-rich stream comprising from about 50 molar percent to about 60 molar percent of the ethane in the unprocessed natural gas stream, the expanded natural gas-rich stream comprising less than or equal to about 15 molar percent of the propane in the unprocessed natural gas stream, and the expanded natural gas-rich stream comprising all of the nitrogen in the unprocessed natural gas stream;

a reflux separator configured to receive the partially condensed stream from the first heat exchanger and separate the vapor portion from the liquid portion;

an expander configured to expand the vapor portion from the reflux separator to produce the expanded natural gas-rich stream that is fed to the first heat exchanger, the expander comprising an expansion turbine that generates energy based on the expansion of the vapor portion, the expander reducing a pressure of the vapor portion, the expander being downstream from the multi-stage separation column, the expander comprising a Joules-Thompson (JT) expander, and the JT expander receiving the vapor portion from the reflux separator and feeding the expanded natural gas-rich stream to the first heat exchanger;

a second heat exchanger configured to receive the expanded natural gas-rich stream from the first heat exchanger and to cool the unprocessed natural gas stream using the expanded natural gas-rich stream;

a compressor that receives the expanded natural gas-rich stream from the second heat exchanger and that compresses the expanded natural gas-rich stream to form a compressed natural gas-rich stream, the compressed natural gas-rich stream comprising only the gas phase such that a vapor fraction of the natural gas-rich stream is one; and a pump configured to pass the liquid portion from the reflux separator to the multi-stage separation column as reflux, the multi-stage separation column comprising three input streams, and the three input streams comprising the unprocessed natural gas stream, the reflux from the single stage separator, and a boil-up stream from a reboiler.

10. The apparatus of claim 9, wherein a third heat exchanger is configured to cool the unprocessed natural gas stream using mechanical refrigeration, and the multi-stage separation column and the reflux separator being the only two separators in the apparatus.

11. The apparatus of claim 10, further comprising a fourth heat exchanger configured to cool the unprocessed natural gas stream using the expanded natural gas-rich stream, and the unprocessed natural gas stream contacting the fourth heat exchanger, then the third heat exchanger, and then the second heat exchanger prior to entering the multi-stage separation column.

12. The process of claim 1, wherein the single stage separator that separates the vapor portion from the liquid portion comprises a phase separator having an inlet and two outlets, the inlet receiving the partially condensed stream from the first heat exchanger, one of the two outlets passing the vapor portion to the JT expander, a second one of the two outlets passing the liquid portion to a pump, and the pump controlling a rate at which the liquid portion is fed back to the multi-stage separation column as reflux.

13. The process of claim 12, wherein the LPG-rich stream comprises about 85 molar percent to about 98 molar percent of the propane from the hydrocarbon feed stream, the LPG-rich stream comprising a truckable product, and the natural gas-rich stream meeting a pipeline specification having a heat content of less than about 1,100 Btu/$ft^3$.

14. The process of claim 4, wherein the single stage separator that separates the vapor portion from the liquid portion comprises a phase separator having an inlet and two outlets, the inlet receiving the partially condensed stream from the first heat exchanger, one of the two outlets passing the vapor portion to the JT expander, a second one of the two outlets passing the liquid portion to a pump, and the pump controlling a rate at which the liquid portion is fed back to the multi-stage separation column as reflux.

15. The process of claim 14, wherein the LPG-rich stream comprises about 85 molar percent to about 98 molar percent of the propane from the hydrocarbon feed stream, the LPG-rich stream comprising a truckable product, and the natural gas-rich stream meeting a pipeline specification having a heat content of less than about 1,100 Btu/$ft^3$.

16. The apparatus of claim 6, wherein the single stage separator that separates the vapor portion from the liquid portion comprises a phase separator having an inlet and two outlets, the inlet receiving the partially condensed stream from the first heat exchanger, one of the two outlets passing the vapor portion to the JT expander, a second one of the two outlets passing the liquid portion to the pump, and the pump controlling a rate at which the liquid portion is fed back to the multi-stage separation column as reflux.

17. The apparatus of claim 16, wherein the LPG-rich stream comprises about 85 molar percent to about 98 molar percent of the propane from the hydrocarbon feed stream, the LPG-rich stream comprising a truckable product, and the natural gas-rich stream meeting a pipeline specification having a heat content of less than about 1,100 Btu/$ft^3$.

18. The apparatus of claim 9, wherein the single stage separator that separates the vapor portion from the liquid portion comprises a phase separator having an inlet and two outlets, the inlet receiving the partially condensed stream from the first heat exchanger, one of the two outlets passing the vapor portion to the JT expander, a second one of the two outlets passing the liquid portion to the pump, and the pump controlling a rate at which the liquid portion is fed back to the multi-stage separation column as reflux.

19. The apparatus of claim 18, wherein the LPG-rich stream comprises about 85 molar percent to about 98 molar percent of the propane from the hydrocarbon feed stream, the LPG-rich stream comprising a truckable product, and the natural gas-rich stream meeting a pipeline specification having a heat content of less than about 1,100 Btu/$ft^3$.

20. The process of claim 1, further comprising passing the hydrocarbon feed stream from the second heat exchanger to a third heat exchanger, the third heat exchanger cooling the hydrocarbon feed stream before the hydrocarbon feed stream is fed to the one multi-stage separation column.

21. The process of claim 1, further comprising sweetening the hydrocarbon feed stream to remove $H_2S$ before separating the hydrocarbon feed stream into the top effluent stream and the LPG-rich stream.

22. The process of claim 1, further comprising:

passing the compressed natural gas-rich stream from the compressor to an air cooler to produce a cooled compressed natural gas-rich stream; and passing the cooled compressed natural gas-rich stream to another compressor to further compress the cooled compressed natural gas-rich stream.

* * * * *